US012098724B2

(12) United States Patent
Jo et al.

(10) Patent No.: US 12,098,724 B2
(45) Date of Patent: Sep. 24, 2024

(54) SCROLL COMPRESSOR

(71) Applicant: LG ELECTRONICS INC., Seoul (KR)

(72) Inventors: Changeol Jo, Seoul (KR); Jeonghun Kim, Seoul (KR); Nara Han, Seoul (KR); Jihoon Park, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

(21) Appl. No.: 18/138,920

(22) Filed: Apr. 25, 2023

(65) Prior Publication Data

US 2024/0077080 A1 Mar. 7, 2024

(30) Foreign Application Priority Data

Sep. 6, 2022 (KR) ..... 10-2022-0113056

(51) Int. Cl.
*F04C 29/12* (2006.01)
*F04C 18/02* (2006.01)
*F04C 29/00* (2006.01)

(52) U.S. Cl.
CPC ..... *F04C 29/124* (2013.01); *F04C 18/0215* (2013.01); *F04C 18/0261* (2013.01); *F04C 29/0035* (2013.01)

(58) Field of Classification Search
CPC ..... F04C 18/0215; F04C 23/008; F04C 18/0261; F04C 2240/30; F04C 28/26; F04C 29/12; F04C 29/124; F04C 29/0035
USPC ..... 137/493, 504, 493.9
See application file for complete search history.

(56) References Cited

U.S. PATENT DOCUMENTS 3,872,884 A * 3/1975 Busdiecker ..... F16K 17/30 137/504
4,044,791 A * 8/1977 McKenzie ..... F16K 17/18 137/513.3
7,140,386 B2 * 11/2006 Avis ..... F16K 17/30 137/460
8,568,118 B2 * 10/2013 Stover ..... F04C 28/26 418/55.5

(Continued)

FOREIGN PATENT DOCUMENTS

CN 209180017 7/2019
KR 10-2381244 3/2022

OTHER PUBLICATIONS

Korean Office Action dated Jan. 16, 2024, issued in Application No. 10-2022-0113056.

*Primary Examiner* — Wesley G Harris
(74) *Attorney, Agent, or Firm* — KED & ASSOCIATES

(57) ABSTRACT

A scroll compressor is disclosed. The scroll compressor may include a back pressure hole formed through a non-orbiting scroll and a back pressure chamber assembly such that a compression chamber and a back pressure chamber communicate with each other. A back pressure valve may be disposed inside of the back pressure hole and move along a longitudinal direction of the back pressure hole by a pressure difference between the compression chamber and the back pressure chamber, to vary a flow path area of the back pressure hole. The back pressure valve may include a valve body that extends in an axial direction and a plurality of holes formed through the valve body in the axial direction. With the configuration, pressure pulsation in the back pressure chamber may be suppressed or prevented.

32 Claims, 13 Drawing Sheets

(56) References Cited

U.S. PATENT DOCUMENTS

| | | | | |
|---|---|---|---|---|
| 8,579,604 | B2 * | 11/2013 | Liang | F04C 18/0215 417/410.5 |
| 9,732,752 | B2 * | 8/2017 | Jin | F04C 18/0246 |
| 9,890,861 | B2 * | 2/2018 | Jin | F16J 15/3224 |
| 9,945,378 | B2 * | 4/2018 | Kouno | F04C 28/26 |
| 9,970,438 | B2 * | 5/2018 | Kim | F01C 17/066 |
| 10,072,658 | B2 * | 9/2018 | Kim | F04C 18/0269 |
| 10,598,180 | B2 * | 3/2020 | Stover | F04C 18/0215 |
| 10,982,674 | B2 * | 4/2021 | Kim | F04C 29/068 |
| 2015/0176585 | A1 | 6/2015 | Sun | |
| 2015/0345493 | A1 | 12/2015 | Lochner et al. | |

* cited by examiner

SCROLL COMPRESSOR

CROSS-REFERENCE TO RELATED APPLICATION

This application claims priority under 35 U.S.C. § 119 to Korean Patent Application No. 10-2022-0113056, filed on Sep. 6, 2022, whose entire disclosure is hereby incorporated by reference.

BACKGROUND

1. Field

A scroll compressor is disclosed herein.

2. Background

A scroll compressor has advantages of obtaining a relatively high compression ratio, as compared with other types of compressors, because refrigerant is continuously compressed by a shape of scrolls engaged with each other and of obtaining stable torques by smooth connection of suction, compression, and discharge strokes. By virtue of those advantages, the scroll compressor is widely used for compressing refrigerant in an air conditioner for example.

Scroll compressors may be classified into a top-compression type or a bottom-compression type depending on positions of a drive motor constituting a drive unit or a motor unit and a compression unit. The top-compression type is configured such that the compression unit is located above the drive motor, whereas the bottom-compression type is configured such that the compression unit is located below the drive motor. This classification is made based on an example in which a casing is vertically installed. When the casing is horizontally installed, a left or first side may be defined as a top and a right or second side as a bottom.

Also, scroll compressors may be classified into a high-pressure type and a low-pressure type according to how refrigerant is suctioned. The high-pressure type is configured such that a refrigerant suction pipe directly communicates with a suction chamber to suction refrigerant into a compression chamber (the suction chamber) without passing through an inner space of a casing, whereas the low-pressure type is configured such that the refrigerant suction pipe communicates with the inner space of the casing to suction the refrigerant into the compression chamber (the suction chamber) after passing through the inner space of the casing.

U.S. Patent Publication No. US 2015/0345493 (hereinafter "Patent Document 1"), which is hereby incorporated by reference, discloses a top compression and low pressure type scroll compressor. In related art scroll compressors, such as that disclosed in Patent Document 1, a sealing state between a non-orbiting scroll and an orbiting scroll can be maintained while the non-orbiting scroll moves along an axial direction of a rotational shaft. This can be classified as a non-orbiting back pressure type scroll compressor.

As described above, in the related art non-orbiting back pressure type scroll compressor, there is no component capable of adjusting back pressure in a refrigerant flow path providing communication between a compression chamber and a back pressure chamber in the process of repeating compression. As a result, pulsation continuously occurs in the back pressure chamber, which acts as a dead body in the compression chamber and causes an increase in compression loss.

U.S. Patent Publication No. US 2015/0176585 (hereinafter "Patent Document 2"), which is hereby incorporated by reference, improves pulsation of an intermediate pressure by mounting a valve in a refrigerant flow path that provides communication between a compression chamber and a back pressure chamber. However, this structure has a complicated valve structure and increases the number of components, thereby causing an increase in manufacturing time and costs of a compressor.

The above references are incorporated by reference herein where appropriate for appropriate teachings of additional or alternative details, features and/or technical background.

BRIEF DESCRIPTION OF THE DRAWINGS

Embodiments will be described with reference to the following drawings in which like reference numerals refer to like elements wherein.

DETAILED DESCRIPTION

Figure 1:
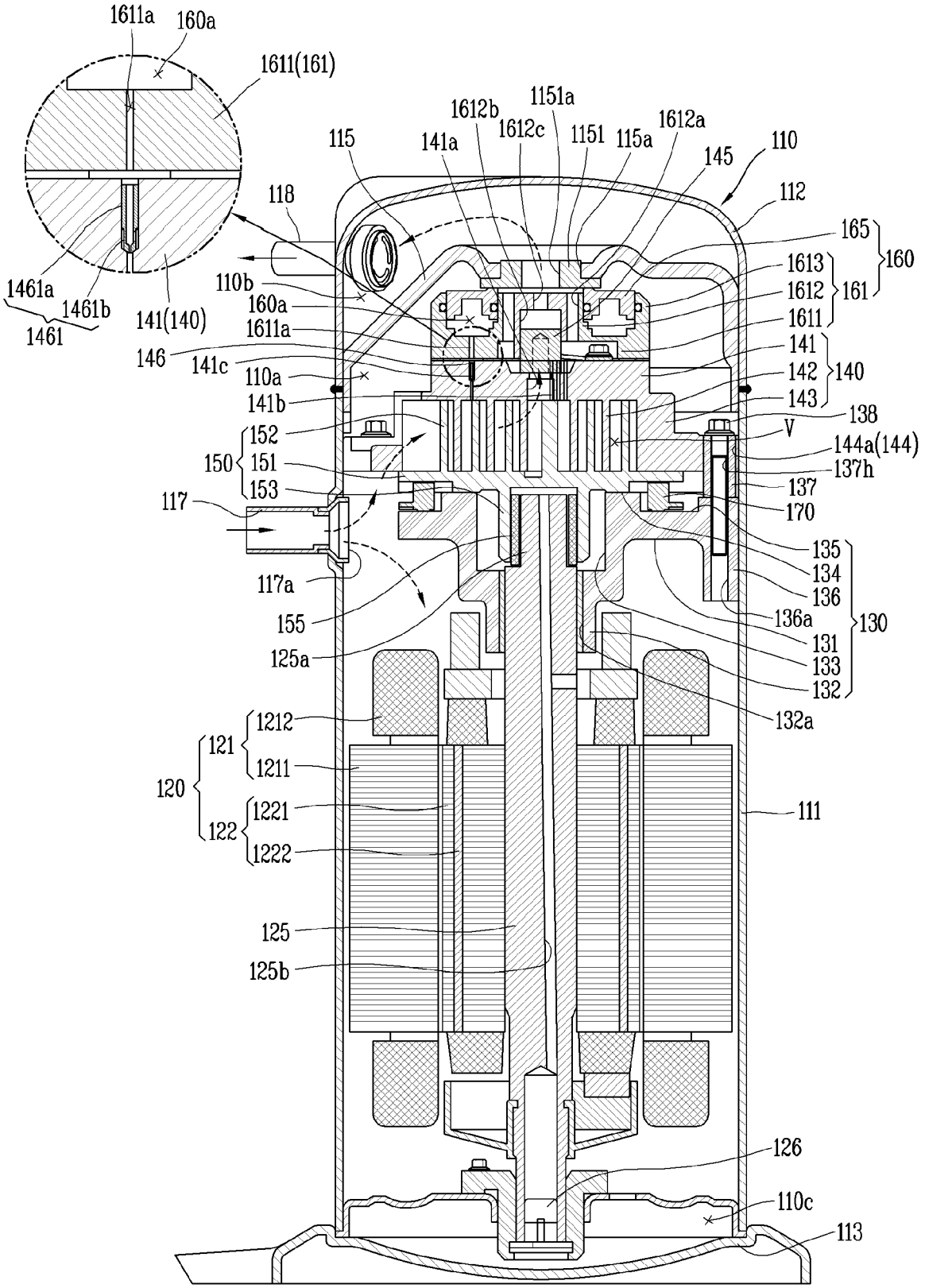
FIG. 1 is a longitudinal cross-sectional view illustrating an inner structure of a scroll compressor in accordance with an embodiment.

Hereinafter, a scroll compressor according to embodiments will be described with reference to the accompanying drawings. As aforementioned, scroll compressors may be classified into a high-pressure scroll compressor and a low-pressure scroll compressor according to a path along which refrigerant is suctioned. Hereinafter, a low-pressure scroll compressor in which an inner space of a casing is divided into a low-pressure part or portion and a high-pressure part or portion by a high/low pressure separation plate and a refrigerant suction pipe communicates with the low-pressure portion will be described as an example.

In addition, scroll compressors may be classified into two types according to a back pressure type (a method of applying back pressure), namely, a non-orbiting back pressure type in which a non-orbiting scroll is pressed toward an orbiting scroll and an orbiting back pressure type in which the orbiting scroll is pressed toward the non-orbiting scroll. Hereinafter, a scroll compressor according to a non-orbiting back pressure type will be mainly described. However, it should be noted that embodiments may be equally applied to the orbiting back pressure type.

In addition, scroll compressors may be classified into two types, namely, a vertical scroll compressor in which a rotational shaft is disposed perpendicular to the ground and a horizontal scroll compressor in which the rotational shaft is disposed parallel to the ground. For example, in the vertical scroll compressor, an upper side may be defined as an opposite side to the ground and a lower side may be defined as a side facing the ground. Hereinafter, the vertical scroll compressor will be described as an example. However, it should be noted that embodiments may be equally applied to the horizontal scroll compressor.

In addition, scroll compressors may be divided into two types, namely, a top compression type and a bottom compression type, depending on a relative position of a compression unit to a motor unit. Hereinafter, a top-compression type scroll compressor that is installed vertically and has a compression unit located above a motor unit will be mainly described.

In addition, scroll compressors may be divided into two types, namely, a fixed radius type and a variable radius type, according to a turning method of an orbiting scroll. Hereinafter, a variable radius type scroll compressor will be mainly described.

In the related art scroll compressor, pulsation continuously occurs in a back pressure chamber communicating with a compression chamber while compression in the compression chamber is repeated. This acts as a dead body in the compression chamber and causes compression loss. Accordingly, embodiments provide a new type of scroll compressor in which pressure pulsation in a back pressure chamber may be suppressed or prevented by providing a back pressure valve, which is movable, inside of a back pressure hole that provides communication between a compression chamber and the back pressure chamber.

As illustrated in FIG. 1, in the scroll compressor according to an embodiment, a drive motor 120 defining a motor unit is disposed in a lower half portion of a casing 110, and a main frame 130, a non-orbiting scroll 140, an orbiting scroll 150, and a back pressure chamber assembly 160, which define a compression unit, are disposed above the drive motor 120. The motor unit is coupled to one or a first end of a rotational shaft 125, and the compression unit is coupled to another or a second end of the rotational shaft 125. Accordingly, the compression unit is connected to the motor unit by the rotational shaft 125 to be operated by a rotational force of the motor unit.

The casing 110 may include a cylindrical shell 111, an upper cap 112, and a lower cap 113. The cylindrical shell 111 may have a cylindrical shape with open upper and lower ends, and the drive motor 120 and the main frame 130 may be fitted on an inner circumferential surface of the cylindrical shell 111 in an inserting manner. A terminal bracket (not illustrated) may be coupled to an upper half portion of the cylindrical shell 111. A terminal (not illustrated) that transmits external power to the drive motor 120 is coupled through the terminal bracket. A refrigerant suction pipe 117 described hereinafter may be coupled to the upper half portion of the cylindrical shell 111, for example, above the drive motor 120.

The upper cap 112 may be coupled to and cover the upper opening of the cylindrical shell 111. The lower cap 113 may be coupled to and cover the lower opening of the cylindrical shell 111.

A rim of a high/low pressure separation plate 115 described hereinafter may be inserted between the cylindrical shell 111 and the upper cap 112 to be welded on the cylindrical shell 111 and the upper cap 112. A rim of a support bracket 116 described hereinafter may be inserted between the cylindrical shell 111 and the lower cap 113 to be, for example, welded on the cylindrical shell 111 and the lower cap 113. Accordingly, the inner space of the casing 110 may be sealed.

The high/low pressure separation plate 115 may be fixed inside of the casing 110 to partition a low-pressure part or portion 110*a* defining a suction space and a high-pressure part or portion 110*b* defining a discharge space. More specifically, a rim of the high/low pressure separation plate 115 may be, for example, welded on the casing 110, as described above. A central portion of the high/low pressure separation plate 115 may be bent and protrude toward an upper surface of the upper cap 112 to be disposed above the back pressure chamber assembly 160 described hereinafter. A refrigerant suction pipe 117 may communicate with a space below the high/low pressure separation plate 115, and a refrigerant discharge pipe 118 may communicate with a space above the high/low separation plate 115. Accordingly, the low-pressure portion 110*a* defining the suction space may be formed below the high/low pressure separation plate 115, while the high-pressure portion 110*b* defining the discharge space may be formed above the high/low pressure separation plate 115.

The refrigerant suction pipe 117 may be coupled through the cylindrical shell 111 in a radial direction. An outlet 117*a* of the refrigerant suction pipe 117 may be disposed to face the compression unit. For example, the outlet 117*a* of the refrigerant suction pipe 117 may be located between main flange portions 131 of the main frame 130 described hereinafter. Accordingly, some of refrigerant suctioned into the low-pressure portion 110*a* through the refrigerant suction pipe 117 may move upward to be directly suctioned into compression chamber V, while the remaining refrigerant may move down toward the motor unit to cool down the drive motor 120 constituting the motor unit. A position at which the refrigerant suction pipe 117 is formed through the cylindrical shell 111 will be described hereinafter.

The refrigerant discharge pipe 118 may be coupled to the upper cap 112 by being inserted through the upper cap 112 in the radial direction. The outlet 117*a* of the refrigerant suction pipe 117 may be located to face an outer surface of the high/low pressure separation plate 115, more specifically, disposed between an inner circumferential surface of the upper cap 112 and an outer circumferential surface of the high/low pressure separation plate 115. Accordingly, refrigerant passing through a high/low pressure communication hole 1151*a* of a sealing plate 1151 described hereinafter may flow along the outer circumferential surface of the high/low pressure separation plate 115 and then flow out of the compressor through the refrigerant discharge pipe 118.

In addition, a through hole 115*a* may be formed through a center of the high/low pressure separation plate 115. A sealing plate 1151 from which a floating plate 165 described hereinafter is detachable, may be inserted into the through hole 115*a*. The low-pressure portion 110*a* and the high-pressure portion 110*b* may be blocked from each other by attachment of the floating plate 165 to the sealing plate 1151 or may communicate with each other through a high/low pressure communication hole 1151*a* of the sealing plate 1151.

The sealing plate 1151 may be formed in an annular shape. For example, the high-low pressure communication hole 1151*a* may be formed through a center of the sealing plate 1151 so that the low-pressure portion 110*a* and the high-pressure portion 110*b* communicate with each other. The floating plate 165 may be detachably coupled along a circumference of the high/low pressure communication hole 1151*a*. Accordingly, the floating plate 165 may be attached to or detached from a circumference of the high/low pressure communication hole 1151*a* of the sealing plate 1151 while moving up and down by back pressure in an axial direction. During this process, the low-pressure portion 110*a* and the high-pressure portion 110*b* may be sealed from each other or communicate with each other.

In addition, the lower cap 113 may define an oil storage space 110*c* together with a lower half portion of the cylindrical shell 111 that defines the low-pressure portion 110*a*. In other words, the oil storage space 110*c* may be defined in the lower half portion of the low-pressure portion 110*a* and define a portion of the low-pressure portion 110*a*.

An oil pickup 126, which will be described hereinafter, may be located inside of the oil storage space 110*c*. Oil stored in the oil storage space 110*c* may be pumped by the oil pickup 126 during operation of the compressor, so as to be supplied to a sliding part or portion through an oil passage 125*b* of the rotational shaft 125.

Next, the drive motor will be described.

Referring back to FIG. 1, the drive motor 120 according to the embodiment may be disposed in the lower half portion of the low-pressure portion 110*a* and includes a stator 121 and a rotor 122. The stator 121 may be, for example, shrink-fitted to an inner wall surface of the casing 111, and the rotor 122 may be rotatably provided inside of the stator 121.

The stator may include a stator core 1211 and a stator coil 1212. The stator core 1211 may be formed in a cylindrical shape, and, may be, for example, shrink-fitted to the inner circumferential surface of the cylindrical shell 111. The stator coil 1212 may be wound around the stator core 1211 and may be electrically connected to an external power source through a terminal (not shown) that is coupled through the casing 110.

The rotor 122 may include a rotor core 1221 and permanent magnets 1222. The rotor core 1221 may be formed in a cylindrical shape, and may be rotatably inserted into the stator core 1211 with a preset or predetermined gap therebetween. The permanent magnets 1222 may be embedded in the rotor core 1222 at preset or predetermined intervals along a circumferential direction.

In addition, the rotational shaft 125 may be press-fitted to a center of the rotor core 1221. An eccentric pin portion 125*a* may be disposed on an upper end of the rotational shaft 125, and an orbiting scroll 150, which will be described hereinafter, may be eccentrically coupled to the eccentric pin portion 125*a*. Accordingly, the rotational force of the drive motor 120 may be transmitted to the orbiting scroll 150 through the rotational shaft 125.

On the other hand, a lower end of the rotational shaft 125 may be coupled to the rotor 122 and an upper end may be coupled to the orbiting scroll 150 described hereinafter. Accordingly, the rotational force of the drive motor 120 may be transmitted to the orbiting scroll 150 through the rotational shaft 125.

The oil passage 125*b* may be formed through the inside of the rotational shaft 125, and the oil pickup 126 that suctions oil stored in the oil storage space 110*c* of the casing 110 is provided in the lower end of the rotational shaft 125. Accordingly, the oil stored in the lower portion of the casing 110 may be suctioned along the oil passage 125*b* of the rotational shaft 125 and move toward an orbiting space portion 133. This oil may then be scattered by a pressure difference and/or by collision with a rotational shaft coupling portion 153, which turns in the orbiting space portion 133, so as to be supplied to bearing surfaces between neighboring members. The oil pickup 126 may be configured as various pumps, such as a centrifugal pump, a viscous pump, or a gear pump, for example. FIG. 1 illustrates an example in which a centrifugal pump is used. Manufacturing costs may be reduced when the centrifugal pump is applied.

Hereinafter, the main frame will be described.

The main frame 130 according to an embodiment illustrated in FIG. 1 may be fixed to the inside of the casing 110 and disposed in the low-pressure portion 110*a*. More specifically, the main frame 130 may be disposed above the drive motor 120 and, for example, shrink-fitted or welded to an inner wall surface of the cylindrical shell 111.

The main frame 130 according to an embodiment may include a main flange portion 131, a main bearing portion 132, orbiting space portion 133, a scroll support portion 134, an Oldham ring accommodation portion 135, and a frame fixing portion 136. The main flange portion 131 may be formed in an annular shape and accommodated in the low-pressure portion 110*a* of the casing 110. An outer diameter of the main flange portion 131 may be formed smaller than an inner diameter of the cylindrical shell 111 so that an outer circumferential surface of the main flange portion 131 is spaced apart from the inner circumferential surface of the cylindrical shell 111. However, frame fixing portion 136 described hereinafter may protrude from an outer circumferential surface of the main flange portion 131 in the radial direction. The outer circumferential surface of the frame fixing portion 136 may be fixed in close contact with an inner circumferential surface of the casing 110. Accordingly, the main frame 130 may be fixedly coupled to the casing 110.

The main bearing portion 132 may protrude downward from a lower surface of a center part or portion of the main flange portion 131 toward the drive motor 120. The main bearing portion 132 may be provided with a bearing hole 132*a* formed therethrough in a cylindrical shape in an axial direction of the rotational shaft 125. The rotational shaft 125 may be inserted into an inner circumferential surface of the bearing hole 132*a* and supported in the radial direction.

The orbiting space portion 133 may be recessed from the center portion of the main flange portion 131 toward the main bearing portion 132 to have a preset or predetermined depth and outer diameter. The orbiting space portion 133 may be larger than an outer diameter of rotational shaft coupling portion 153 provided on the orbiting scroll 150 described hereinafter. Accordingly, the rotational shaft coupling portion 153 may be pivotally accommodated in the orbiting space portion 133.

In addition, oil suctioned through the rotational shaft 125 may be temporarily stored inside of the orbiting space portion 133. The oil may be supplied to a gap between the main bearing portion 132 and the rotational shaft 125 and/or between the scroll support portion 134 and the orbiting scroll 150.

The scroll support portion 134 may be formed in an annular shape on an upper surface of the main flange portion 131 along a periphery of the orbiting space portion 133. Accordingly, the scroll support portion 134 may support a lower surface of an orbiting end plate 151 described hereinafter in the axial direction.

The Oldham ring support portion 135 may be formed outside of the scroll support portion 134 and have a height lower than a height of the scroll support portion 134. More specifically, the Oldham ring support portion 135 may be formed in an annular shape on an upper surface of the main flange portion 131 along an outer circumferential surface of the scroll support portion 134 to be lower than the height of the scroll support portion 134. The Oldham ring 170 may be placed on the Oldham ring support portion 135 to suppress or prevent rotation of the orbiting scroll 150 described hereinafter. Accordingly, the Oldham ring 170 may be pivotably accommodated by being inserted into the Oldham ring support portion 135.

The frame fixing portion 136 may be formed outside of the Oldham ring support portion 135 so that the main frame 130 may be fixed to the casing 110. More specifically, the frame fixing portion 136 may extend radially from an outer periphery of the Oldham ring accommodation portion 135.

The frame fixing portion 136 may extend in an annular shape or extends to form a plurality of protrusions spaced apart from one another by preset or predetermined distances. FIG. 1 illustrates an example in which the frame fixing portion 136 has a plurality of protrusions along the circumferential direction.

For example, the plurality of frame fixing portions 136 may be arranged to face guide protrusions 144 of the non-orbiting scroll 140 described hereinafter in the axial direction of the rotational shaft 125, respectively, and each of the frame fixing portions 136 may be provided with a bolt fastening hole 136*a* formed therethrough in the axial direction of the rotational shaft 125 to correspond to a guide insertion hole 144*a* of the non-orbiting scroll 140 described hereinafter.

An inner diameter of the bolt fastening hole 136*a* may be smaller than an inner diameter of the guide insertion hole 144*a*. Accordingly, a stepped surface that extends from an inner circumferential surface of the guide insertion hole 144*a* may be formed around an upper surface of the bolt fastening hole 136*a*, and a guide bush 137 inserted through the guide insertion hole 144*a* may be placed on the stepped surface to be supported by the frame fixing portion 136 in the axial direction of the rotational shaft 125.

The guide bush 137 may be formed in a cylindrical shape, for example. That is, the guide bush 137 may include a bolt insertion hole 137*h* formed therethrough in a longitudinal direction of the guide bush 137 or in the axial direction of the rotational shaft 125.

Guide bolts 138 may be inserted through the bolt insertion holes 137*h* to be fastened to the bolt fastening holes 136*a* of the frame fixing portion 136, respectively. The non-orbiting scroll 140 may be thusly slidably supported on the main frame 130 in the axial direction of the rotational shaft 125 and fixed to the main frame 130 in the radial direction.

Hereinafter, the non-orbiting scroll will be described.

The non-orbiting scroll 140 according to the embodiment illustrated in FIG. 1 may be disposed on an upper side of the main frame 130 with the orbiting scroll 150 described hereinafter interposed therebetween. In other words, the non-orbiting scroll 140 may be disposed with the orbiting scroll 150 interposed therebetween, to be axially movable with respect to one side surface of the main frame 130. The non-orbiting scroll 140 defines compression chamber V together with the orbiting scroll 150.

The non-orbiting scroll 140 may be fixedly coupled to the main frame 130 or may be coupled to the main frame 130 to be movable up and down. FIG. 1 illustrates an example in which the non-orbiting scroll 140 is coupled to the main frame 130 to be movable relative to the main frame 130 in the axial direction of the rotational shaft 125.

The non-orbiting scroll 140 according to an embodiment may include a non-orbiting end plate 141, a non-orbiting wrap 142, a non-orbiting side wall portion 143, and a guide protrusion 144. The non-orbiting end plate 141 may be formed, for example, in a disk shape and disposed in a horizontal direction in the low-pressure portion 110*a* of the casing 110. A discharge port 141*a*, a bypass hole 141*b*, and a scroll-side back pressure hole 141*c* may be formed through a center part or portion of the non-orbiting end plate 141 in the axial direction of the rotational shaft 125.

The discharge port 1411 may be formed at a position where discharge pressure chambers (no reference numeral given) of both compression chambers V formed inside and outside of the non-orbiting wrap 142 communicate with each other. The bypass hole 141*b* may communicate with both compression chambers V. The scroll-side back pressure hole 141*c* may be spaced apart from the discharge port 141*a* and the bypass hole 141*b*.

The scroll-side back pressure hole 141*c* will be described hereinafter.

Figure 2:
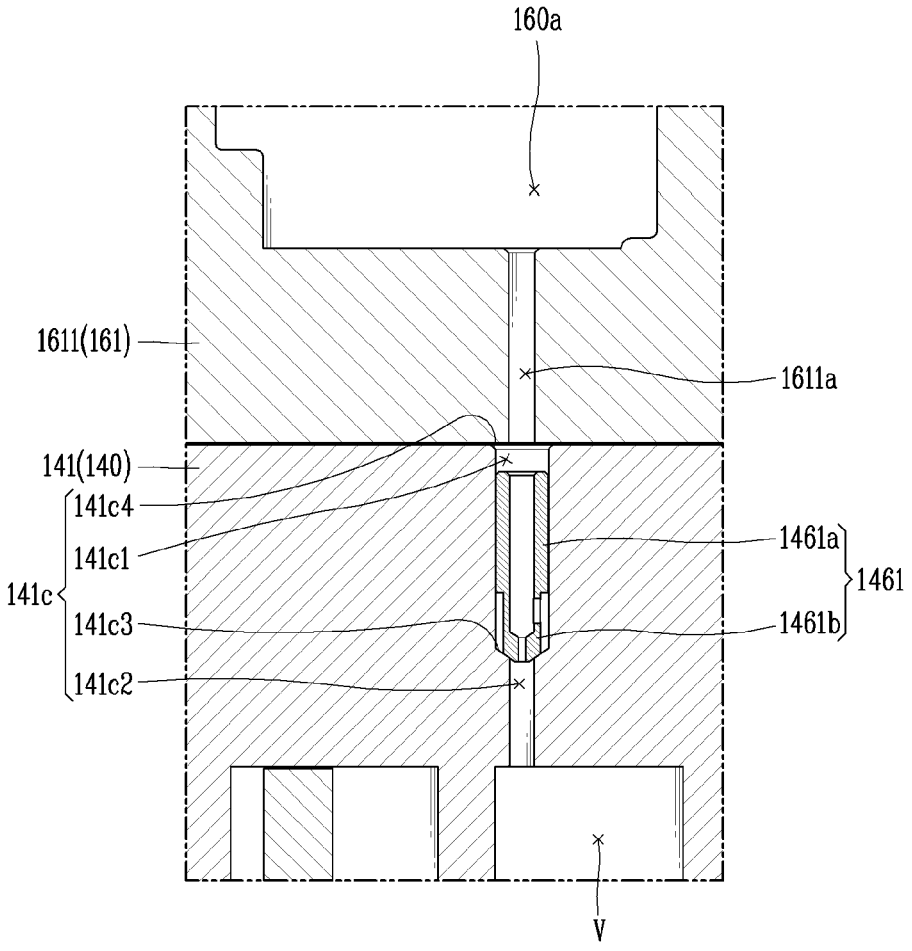
FIG. 2 is a longitudinal cross-sectional view illustrating an embodiment in which a back pressure valve of FIG. 1 is disposed inside of a scroll-side back pressure hole.

As illustrated in FIGS. 1 and 2, the scroll compressor according to an embodiment may include a back pressure hole. The back pressure hole is a refrigerant flow path (passage) that is defined in the non-orbiting scroll 140 and the back pressure chamber assembly 160 described hereinafter to communicate with the compression chamber V and the back pressure chamber 160*a*, such that compressed refrigerant flows therealong. The compression chamber V may be defined by the non-orbiting scroll 140 and the orbiting scroll 150 together, and the back pressure chamber 160*a* may be defined by the back pressure chamber assembly 160 described hereinafter, more specifically, a back pressure plate 161 together with a floating plate 165.

The back pressure hole may include a scroll-side back pressure hole 141*c* formed in the non-orbiting scroll 140 and communicating with the compression chamber V, and a plate-side back pressure hole 1611*a* formed in the back pressure chamber assembly 160 and communicating with the scroll-side back pressure hole 141*c* and the back pressure chamber 160*a*. Hereinafter, the scroll-side back pressure hole 141*c* will be described first, and the plate-side back pressure hole 1611*a* will be described hereinafter in relation to the back pressure chamber assembly 160 described hereinafter.

The scroll-side back pressure hole 141*c* is a hole that is formed in the non-orbiting scroll 140, more specifically, the non-orbiting end plate 141, and communicates with the compression chamber V. During operation of the compressor, compressed refrigerant in the compression chamber V moves to the back pressure chamber 160*a* through the scroll-side back pressure hole 141*c*. When the operation of the compressor is stopped, the refrigerant in the back pressure chamber 160*a* moves to the compression chamber V through the scroll-side back pressure hole 141*c*.

The scroll-side back pressure hole 141*c* communicates with the plate-side back pressure hole 1611*a* described hereinafter, and is formed therethrough up to the compression chamber V from one surface of the non-orbiting scroll 140 facing the back pressure chamber assembly 160. The one surface of the non-orbiting scroll 140 indicates one surface of the non-orbiting end plate 141, and the one surface of the non-orbiting end plate 141 is an upper surface facing the back pressure chamber assembly 160.

Figure 3:
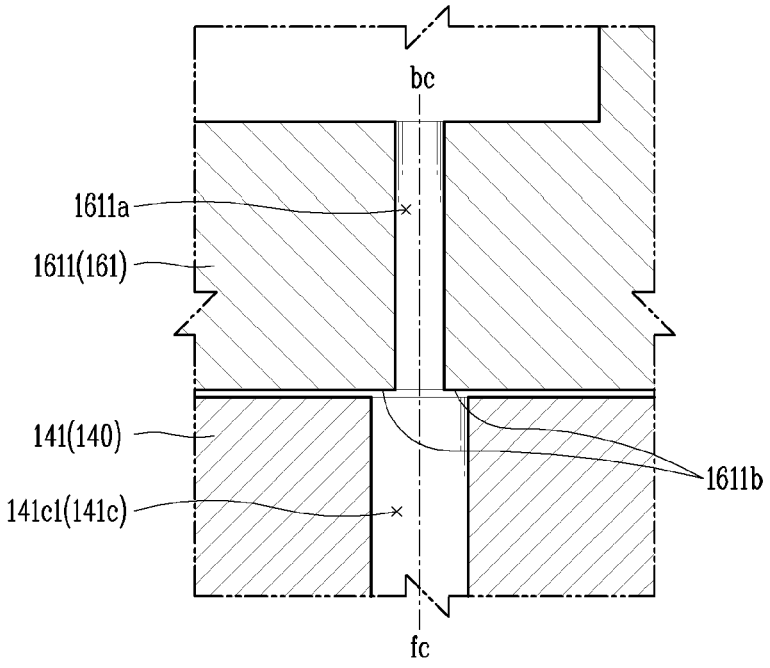
FIG. 3 is a view illustrating an embodiment in which centers of a scroll-side back pressure hole and a plate-side back pressure hole are located on a same axis.

As illustrated in FIG. 3, a central axis fc of the scroll-side back pressure hole 141*c* and a central axis bc of the plate-side back pressure hole 1611*a* may be disposed coaxially with each other. Accordingly, the scroll-side back pressure hole 141*c* and the plate-side back pressure hole 1611*a* may communicate with each other, such that refrigerant may smoothly move along the scroll-side back pressure hole 141*c* and the plate-side back pressure hole 1611*a*.

An inner diameter of the scroll-side back pressure hole 141*c* may be larger than an inner diameter of the plate-side back pressure hole 1611*a*. Due to this, a portion of the scroll-side back pressure hole 141*c* may be covered by one surface 1611*b* of the back pressure chamber assembly 160. When a back pressure valve 146 described hereinafter is disposed inside of the scroll-side back pressure hole 141*c*, the back pressure valve 146 axially overlaps the one surface 1611*b* of the back pressure chamber assembly 160 that covers the scroll-side back pressure hole 141*c*. Accordingly, the one surface 1611*b* of the back pressure chamber assembly 160 restricts movement of the back pressure valve 146. More specifically, the one surface 1611*b* of the back pressure chamber 160 allows the back pressure valve 146 to be movable only inside of the scroll-side back pressure hole 141*c* and restricts the back pressure valve 146 from moving out of the scroll-side back pressure hole 141*c* toward the plate-side back pressure hole 1611*a*. Hereinafter, the one surface 1611*b* of the back pressure chamber assembly 160 is referred to as a "valve restricting portion" 1611*b*.

Figure 4:
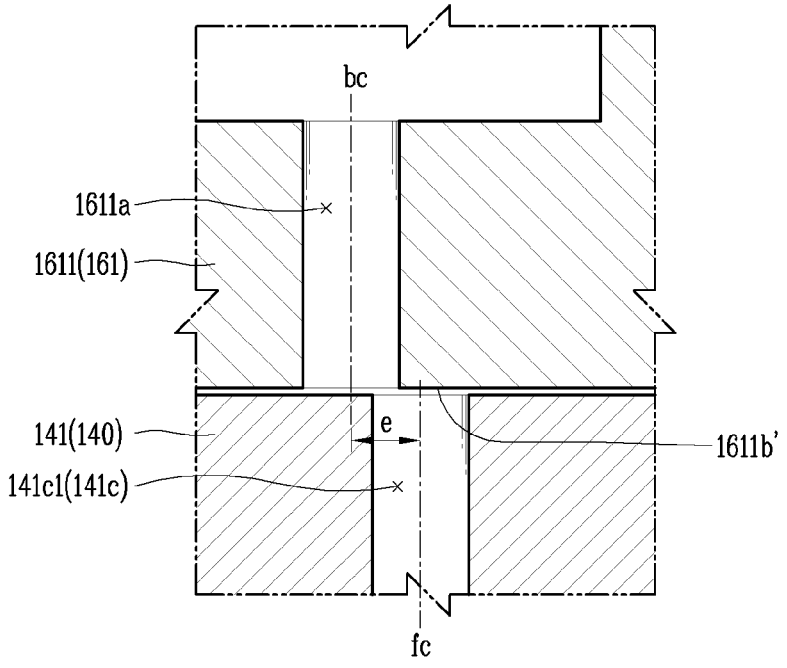
FIG. 4 is a view illustrating an embodiment in which centers of a scroll-side back pressure hole and a plate-side back pressure hole are eccentric from each other.

In addition, as illustrated in FIG. 4, according to another embodiment, the scroll-side back pressure hole 141*c* may be formed eccentrically with respect to the plate-side back pressure hole 1611*a*, but communicate with the plate-side back pressure hole 1611*a*. More specifically, the central axis fc of the scroll-side back pressure hole 141*c* may be spaced apart from the central axis bc of the plate-side back pressure hole 1611*a* by a preset or predetermined distance e, but the scroll-side back pressure hole 141*c* may communicate with the plate-side back pressure hole 1611*a*. Due to this, a portion of the scroll-side back pressure hole 141*c* may be covered by one surface 1611*b*' of the back pressure chamber assembly 160. When the back pressure valve 146 described hereinafter is disposed inside of the scroll-side back pressure hole 141*c*, the back pressure valve 146 axially overlaps the one surface 1611*b*' of the back pressure chamber assembly 160 that covers the scroll-side back pressure hole 141*c*. Accordingly, the one surface 1611*b*' of the back pressure chamber assembly 160 restricts movement of the back pressure valve 146. More specifically, the one surface 1611*b*' of the back pressure chamber 160 allows the back pressure valve 146 to be movable only inside the scroll-side back pressure hole 141*c* and restricts the back pressure valve 146 from moving out of the scroll-side back pressure hole 141*c* toward the plate-side back pressure hole 1611*a*. Hereinafter, the one surface 1611*b*' of the back pressure chamber assembly 160 is referred to as a valve restricting portion 1611*b*'.

The scroll-side back pressure hole 141*c* may include a first scroll-side back pressure hole 141*c*1 that communicates with the plate-side back pressure hole 1611*a*, and a second scroll-side back pressure hole 141*c*2 having one or a first end that communicates with the first scroll-side back pressure hole 141*c*1 and another or a second end that communicates with the compression chamber V. More specifically, the first scroll-side back pressure hole 141*c*1 may communicate with the plate-side back pressure hole 1611*a*, and may be formed (recessed) by a preset or predetermined depth into one surface of the non-orbiting scroll 140 (more specifically, one surface of the non-orbiting end plate 141) facing the back-pressure chamber assembly 160. The second scroll-side back pressure hole 141*c*2 may be formed through from the first scroll-side back pressure hole 141*c*1 to the compression chamber V.

Figure 6:
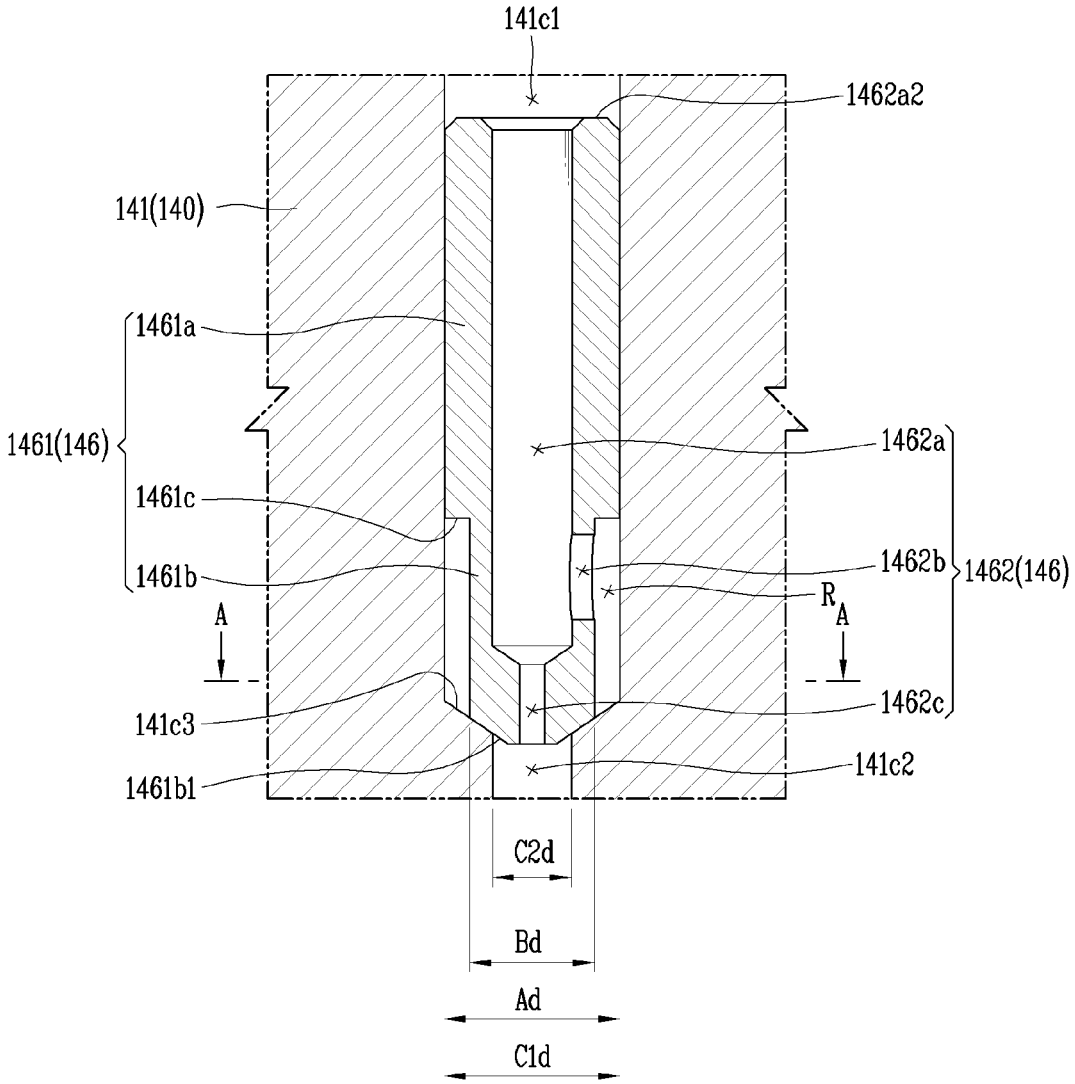
FIG. 6 is a schematic view illustrating an embodiment in which the back pressure valve of FIG. 5 is seated on a stepped portion.

As illustrated in FIG. 6, an inner diameter C1*d* of the first scroll-side back pressure hole 141*c*1 may be larger than an inner diameter C2*d* of the second scroll-side back pressure hole 141*c*2, and a stepped portion 141*c*3 that restricts movement of the back pressure valve 146 may be formed between the first scroll-side back pressure hole 141*c*1 and the second scroll-side back pressure hole 141*c*2. More specifically, the stepped portion 141*c*3 may be formed at a portion (boundary region) where the first scroll-side back pressure hole 141*c*1 and the second scroll-side back pressure hole 141*c*2 are connected to each other, and inclined in a direction toward the second scroll-side back pressure hole 141*c*2. For this reason, the back pressure valve 146 described hereinafter is movably disposed inside of the first scroll-side back pressure hole 141*c*1 but is seated on the stepped portion 141*c*3 so as to be restricted from moving toward the second scroll-side back pressure hole 141*c*2.

In addition, the first scroll-side back pressure hole 141*c*1 may include a tapered portion 141*c*4 formed by tapering one or a first end portion thereof opposite to the stepped portion 141*c*3. The tapered portion 141*c*4 may facilitate the back pressure valve 146 to be inserted into the first scroll-side back pressure hole 141*c*1 during a manufacturing process of the compressor. The tapered portion 141*c*4 may not be formed according to another embodiment. This may shorten a manufacturing time of the compressor. FIGS. 3 and 4 illustrate an embodiment in which the one end portion of the first scroll-side back pressure hole 141*c*1 is not tapered.

As described above, in the case of the another embodiment in which the scroll-side back pressure hole 141*c* is formed eccentrically with respect to the plate-side back pressure hole 1611*a* (see FIG. 4), the first scroll-side back pressure hole 141*c*1 and the second scroll-side back pressure hole 141*c*2 may be arranged to be eccentric from the plate-side back pressure hole 1611*a*. In other words, the first scroll-side back pressure hole 141*c*1 is formed to communicate with the plate-side back pressure hole 1611*a* while the one end portion thereof is eccentric from the plate-side back pressure hole 1611*a*. More specifically, the central axis fc of the scroll-side back pressure hole 141*c*1 may be spaced apart from the central axis bc of the plate-side back pressure hole

1611*a* by a preset or predetermined distance e, but the one end portion of the scroll-side back pressure hole 141*c*1 communicates with the plate-side back pressure hole 1611*a*.

A portion of the scroll-side back pressure hole 141*c*, more specifically, a portion of the first scroll-side back pressure hole 141*c*1 may be covered by the valve restricting portion 1611*b*', and the back pressure valve 146 axially overlaps the valve restricting portion 1611*b*' that covers the first scroll-side back pressure hole 141*c*1. Accordingly, the valve restricting portion 1611*b*' may allow the back pressure valve 146 to move only inside of the first scroll-side back pressure hole 141*c*1 and restrict the back pressure valve 146 from moving out of the first scroll-side back pressure hole 141*c*1 toward the plate-side back pressure hole 1611*a*.

The scroll compressor according to this embodiment may include the back pressure valve 146 that moves inside of the back pressure hole along a longitudinal direction of the back pressure hole by a pressure difference between the compression chamber V and the back pressure chamber 160*a*, to vary a flow path area of the back pressure hole. The flow path area represents an area of a refrigerant flow path through which refrigerant moves. The back pressure valve 146 is disposed inside of the back pressure hole and moves along the inside of the back pressure hole to change the area of the refrigerant flow path, thereby improving pressure pulsation in the back pressure chamber.

The back pressure valve 146 may move while being inserted in the back pressure hole (more specifically, the scroll-side back pressure hole 141*c*). More specifically, the back pressure valve 146 may slide while being inserted in the back pressure hole (the scroll-side back pressure hole 141*c*). The scroll-side back pressure hole 141*c* indicates a first scroll-side back pressure hole 141*c*1. That is, the back pressure valve 146 may be inserted into the first scroll-side back pressure hole 141*c*1 and slide along a lengthwise direction of the first scroll-side back pressure hole 141*c*1 so that an area of the refrigerant flow path may vary.

The back pressure valve 146 serves to suppress or prevent pressure pulsation in the back pressure chamber 160*a*. To elaborate on it, when the compressor is operated and pressure in the compression chamber V rises (when a pressure in the compression chamber V is higher than a pressure in the back pressure chamber 160*a*), the back pressure valve 146 operates to enlarge a space of the refrigerant flow path such that compressed refrigerant in the compression chamber V may easily move to the back pressure chamber 160*a*. When the compressor is stopped and the pressure in the compression chamber V decreases (when the pressure in the compression chamber V is lower than the pressure in the back pressure chamber 160*a*), the back pressure valve 146 operates to reduce the space of the refrigerant flow path such that the compressed refrigerant in the back pressure chamber 160*a* may easily move to the compression chamber V. Therefore, the back pressure valve 146 does not interfere with a pressure increase in the back pressure chamber 160*a* when the pressure in the compression chamber V rises, and suppresses or prevents the pressure pulsation in the back pressure chamber 160*a* when the pressure in the compression chamber V is lowered.

Figure 5:
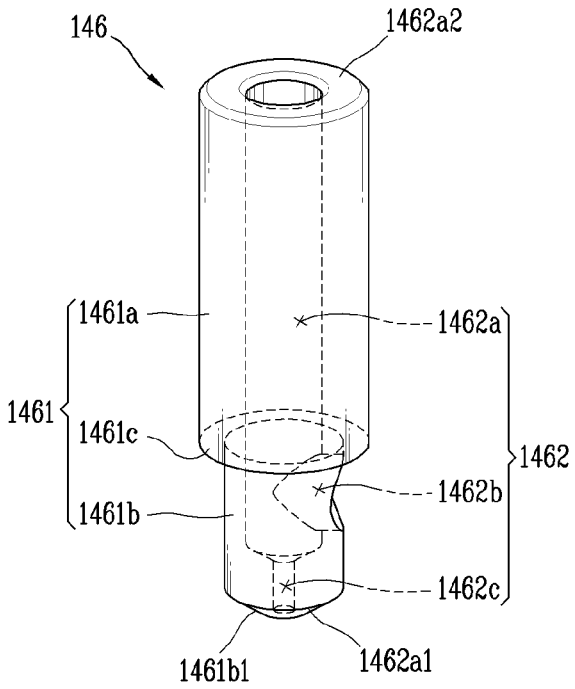
FIG. 5 is a perspective view illustrating the back pressure valve of FIG. 1.
Figure 7:
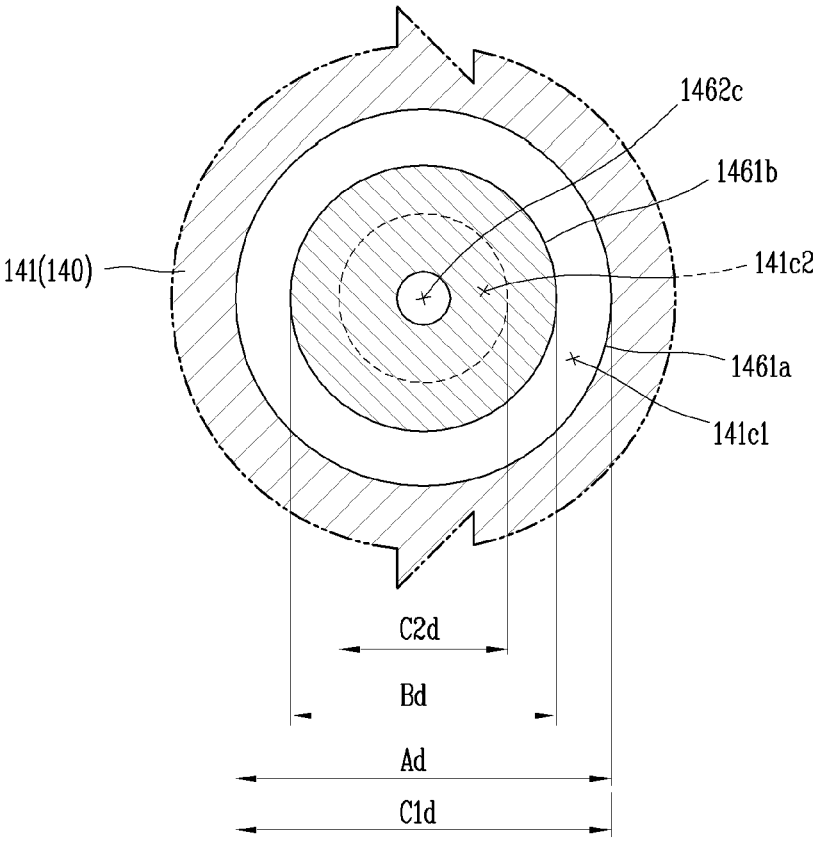
FIG. 7 is a planar view of a portion A-A of FIG. 6.

As illustrated in FIGS. 5 to 7, the back pressure valve 146 may include a valve body 1461 that slides while being inserted in the back pressure hole (more specifically, the scroll-side back pressure hole 141*c*), and a plurality of holes 1462 formed through the inside of the valve body 1461 to communicate with each other. The scroll-side back pressure hole 141*c* indicates a first scroll-side back pressure hole 141*c*1. That is, the valve body 1461 may be inserted into the first scroll-side back pressure hole 141*c*1 and slide along a lengthwise direction of the first scroll-side back pressure hole 141*c*1 so that an area of the refrigerant flow path can vary.

The valve body 1461 may include a main body 1461*a* disposed on or at a side of the back pressure chamber 160*a*, and an extension body 1461*b* that extends axially from the main body 1461*a* and disposed on or at a side of the compression chamber V. A cross-sectional area of the main body 1461*a* in the radial direction may be larger than a cross-sectional area of the extension body 1461*b* in the radial direction. Accordingly, a pressing surface 1461*c* may be formed in a boundary region between the main body 1461*a* and the extension body 1461*b* such that an outer surface of the main body 1461*a* and an outer surface of the extension body 1461*b* are stepped from each other. The pressure surface 1461*c* allows the back pressure valve 146 to slide toward the back pressure chamber 160*a*. In other words, when the compressed refrigerant in the compression chamber V moves to the back pressure chamber 160*a*, the refrigerant presses the pressure surface 1461*c*, and the back pressure valve 146 slides from the inside of the first scroll-side back pressure hole 141*c*1 toward the back pressure chamber 160*a* by pressing force P (see FIG. 8).

A cross-sectional shape of the main body 1461*a* may correspond to a cross-sectional shape of the first scroll-side back pressure hole 141*c*1. More specifically, a cross-sectional shape of an outer surface of the main body 1461*a* in the radial direction may correspond to a cross-sectional shape of the first scroll-side back pressure hole 141*c*1 in the radial direction. For example, when the cross-sectional shape of the first scroll-side back pressure hole 141*c*1 in the radial direction is circular, the cross-sectional shape of the outer surface of the main body 1461*a* in the radial direction may also be circular. Accordingly, when the first scroll-side back pressure hole 141*c*1 is formed in a cylindrical shape, the main body 1461*a* may be formed in a cylindrical shape having a preset or predetermined length.

Referring to FIG. 6, a diameter Ad of the main body 1461*a* and an inner diameter C1*d* of the first scroll-side back pressure hole 141*c*1 are shown to be the same, but this is schematically illustrated. The diameter Ad of the main body 1461*a* may be smaller than the inner diameter of the first scroll-side back pressure hole 141*c*1 such that the main body 1461*a* may slide along the longitudinal direction of the first scroll-side back pressure hole 141*c*1 inside of the first scroll-side back pressure hole 141*c*1. However, it can be seen that a very minute gap is present between an outer surface of the main body 1461*a* and an inner surface of the first scroll-side back pressure hole 141*c*1. Therefore, an amount of refrigerant moving through the gap may be negligibly smaller than an amount of refrigerant moving through the refrigerant flow path passing through the back pressure valve 146. Due to this, when the back pressure valve 146 moves along the longitudinal direction of the first scroll-side back pressure hole 141*c*1, the main body 1461*a* may serve as a guide.

The main body 1461*a* may include a refrigerant flow path defined therethrough in the axial direction. This will be described hereinafter.

The extension body 1461*b* may extend from the main body 1461*a* toward the orbiting scroll 150. The refrigerant flow path defined through the main body 1461*a* in the axial direction extends inside of the extension body 1461*b* and passes through the extension body 1461*b* in the axial direction.

A cross-sectional shape of the extension body 1461*b* may correspond to a cross-sectional shape of the first scroll-side back pressure hole 141*c*1; however, embodiments are not limited thereto. In other words, a cross-sectional shape of an outer surface of the extension body 1461*b* in the radial direction may correspond to a cross-sectional shape of the first scroll-side back pressure hole 141*c*1 in the radial direction; however, embodiments are not limited thereto. For example, when the cross-sectional shape of the first scroll-side back pressure hole 141*c*1 in the radial direction is circular, the cross-sectional shape of the outer surface of the extension body 1461*b* in the radial direction may be circular. However, it is not limited to the circular shape but may be formed in a shape other than the circular shape.

A diameter Bd of the extension body 1461*b* may be larger than an inner diameter C2*d* of the second scroll-side back pressure hole 141*c*2. Due to this, the back pressure valve 146 cannot move into the second scroll-side back pressure hole 141*c*2. When the compressor is stopped and pressure in the compression chamber V is lowered, the back pressure valve 146 is seated on the stepped portion 141*c*3, and is closely brought into contact with the stepped portion 141*c*3 by the compressed refrigerant in the back pressure chamber 160*a*. Accordingly, an area of the refrigerant flow path is varied.

A central axis of the extension body 1461*b* may be coaxial with a central axis of the main body 1461*a*, and the cross-sectional area of the extension body 1461*b* in the radial direction may be smaller than the cross-sectional area of the main body 1461*a* in the radial direction. Alternatively, the diameter Bd of the extension body 1461*b* may be shorter than the diameter Ad of the main body 1461*a*. Accordingly, the pressing surface 1461*c* may be formed in a boundary region between the main body 1461*a* and the extension body 1461*b* such that an outer surface of the main body 1461*a* and an outer surface of the extension body 1461*b* are stepped from each other.

The pressing surface 1461*c* may be inclined in a direction toward the second scroll-side back pressure hole 141*c*2. However, embodiments are not limited thereto and may be formed not to be inclined. This may improve efficiency of selecting the shape of the pressing surface 1461*c*.

The compressed refrigerant in the compression chamber A is introduced into a space (referred to as 'refrigerant pressing space R') (see FIG. 6) that is defined by the pressing surface 1461*c*, an inner circumferential surface of the first scroll-side back pressure hole 141*c*1, and the outer surface of the extension body 1461*b*. The introduced refrigerant presses the pressing surface 1461*c* such that the valve body 1461 is slid toward the back pressure chamber 160*a* and also is introduced into a side hole 1462*b* formed in the extension body 1461*b*, which will be described hereinafter.

The back pressure valve 146 may include a plurality of holes 1462 formed through the valve body 1461. That is, the plurality of holes 1462 may be formed through the valve body 1461 of the back pressure valve 146.

The valve body 1461 may include first hole 1462*c* formed in a compression chamber-side end portion 1462*a*1, second hole 1462*a* that communicates with the first hole 1462*c* and extends from the first hole 1462*c* to a back pressure chamber-side end portion 1462*a*2 while its inner diameter increases more than that of the first hole 1462*c*, and a side hole 1462*b* that communicates with the second hole 1462*a* and formed between the compression chamber-side end portion 1462*a*1 and the back pressure chamber-side end portion 1462*a*2.

The first hole 1462*c* may be formed through the compression chamber-side end portion 1462*a*1, which is one or a first end portion of the valve body 1461, and the second hole 1462*a* is formed through the back pressure chamber-side end portion 1462*a*2, which is another or a second end portion of the valve body 1461.

An inner diameter of the second hole 1462*a* is larger (extends further) than an inner diameter of the first hole 1462*c*. As a result, refrigerant passing through the first hole 1462*c* may smoothly move to the second hole 1462*a* in which the flow path has an enlarged cross-sectional area. However, contrary to this, the refrigerant passing through the second hole 1462*a* cannot move smoothly but may move slowly to the first hole 1462*c*, in which the flow path has a reduced cross-sectional area.

In addition, the side hole 1462*b* that communicates with the second hole 1462*a* may be formed through a side surface of the valve body 1461. The side hole 1462*b* may be formed between the compression chamber-side end portion 1462*a*1 and the pressing surface 1461*c*. In other words, the side hole 1462*b* may be formed through the side surface of the extension body 1461*b*. Accordingly, the compressed refrigerant introduced into the refrigerant pressing space R may move to the back pressure chamber 160*a* sequentially through the side hole 1462*b* and the second hole 1462*a*.

Figure 8:
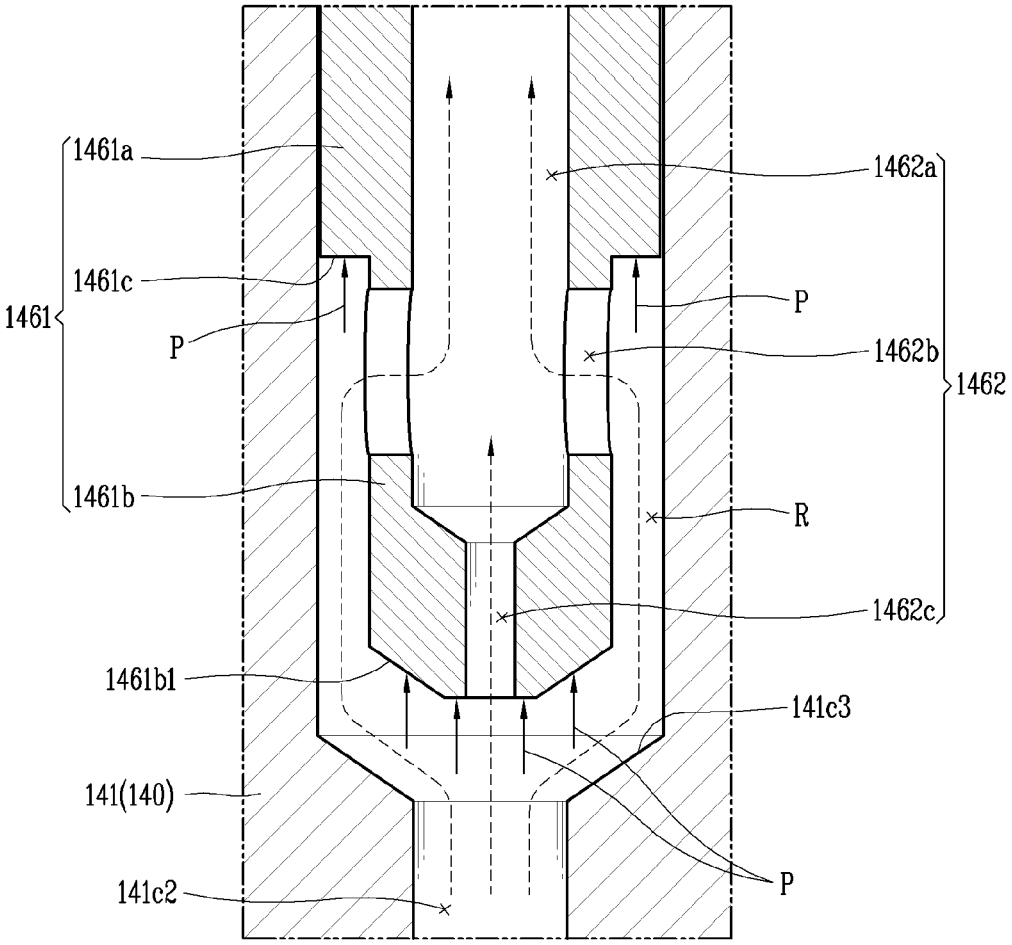
FIG. 8 is a longitudinal cross-sectional view illustrating a position of a back pressure valve and a movement path of refrigerant when pressure in a compression chamber increases in accordance with an embodiment.
Figure 9:
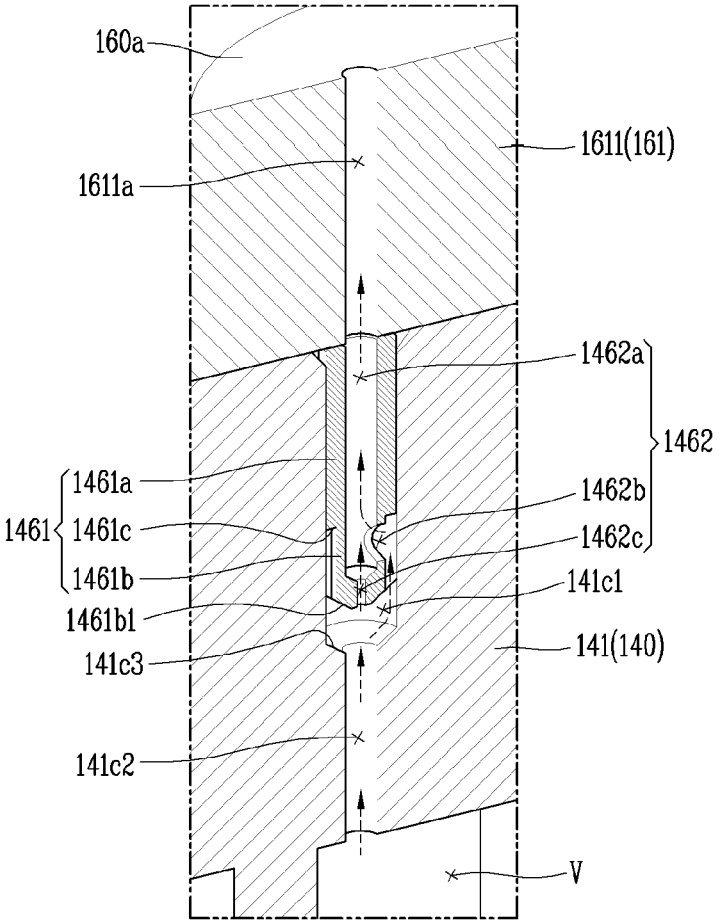
FIG. 9 is a cutout perspective view illustrating a portion of the scroll compressor of FIG. 8.
Figure 10:
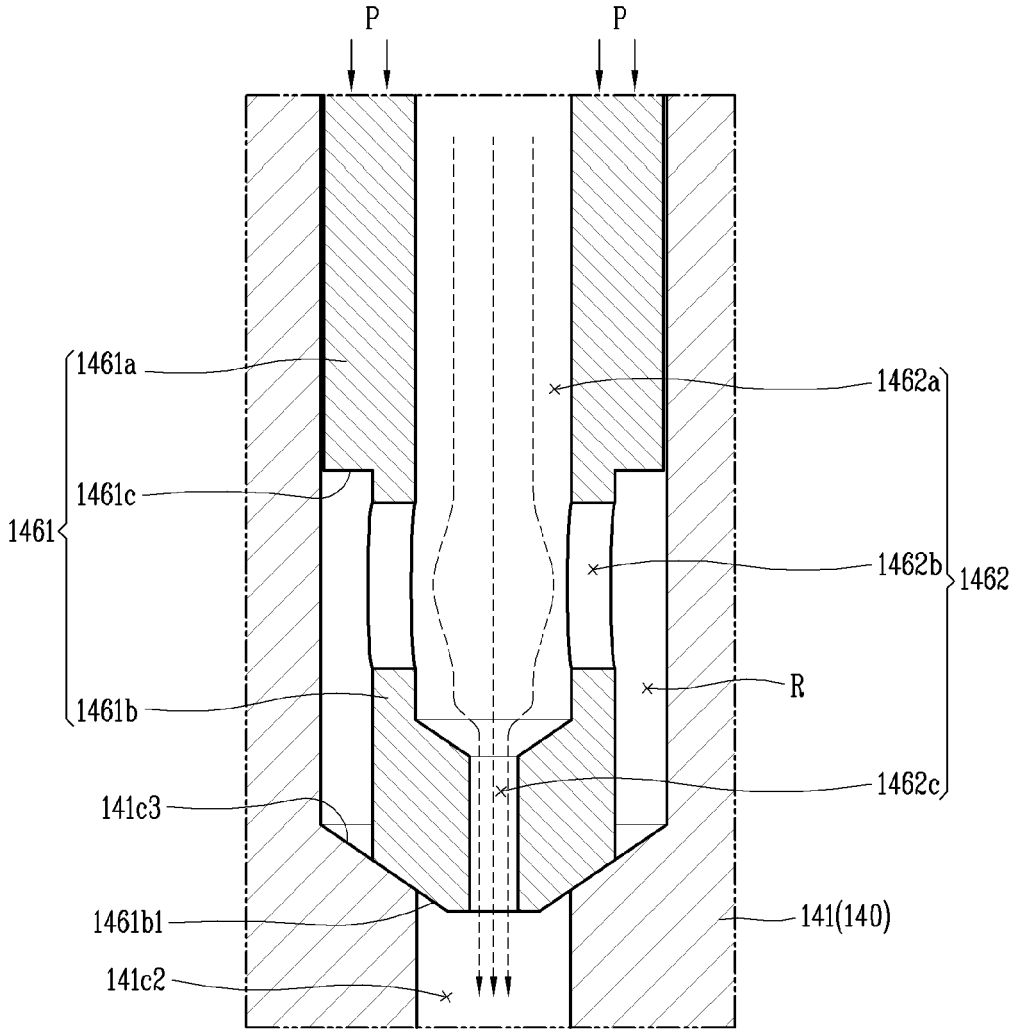
FIG. 10 is a longitudinal cross-sectional view illustrating a position of the back pressure valve and a movement path of refrigerant when pressure in the compression chamber decreases in accordance with an embodiment.
Figure 11:
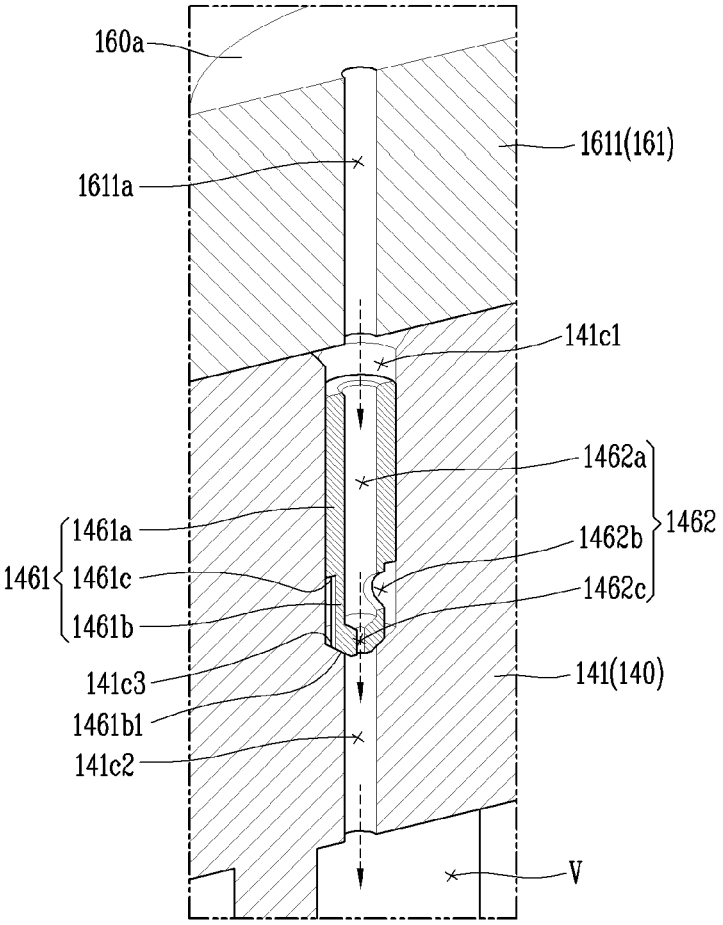
FIG. 11 is a cutout perspective view illustrating a portion of the scroll compressor of FIG. 10.

As illustrated in FIGS. 6, 8, and 10, one or more side holes 1462*b* may be formed. FIG. 6 illustrates an embodiment including one side hole 1462*b*, and FIGS. 8 and 10 illustrate an embodiment including two side holes 1462*b*.

The plurality of side holes 1462*b* may be formed in the side surface of the valve body 1461 (more specifically, the extension body 1461*b*) at an equal interval along a circumferential direction. Accordingly, the refrigerant may uniformly move to the refrigerant pressing space R, and uniformly press the pressing surface 1461*c*. In addition, in order to induce a smooth flow of refrigerant, an inner diameter of each of the plurality of side holes 1462*b* may be smaller than an inner diameter of the second hole 1462*a* so that an amount of refrigerant passing through all the plurality of side holes 1462*b* is controlled to be the same as or smaller than an amount of refrigerant passing through the second hole 1462*a*.

The inner diameter of each of the side holes 1462*b* may be smaller than that of the second hole 1462*a*. As a result, refrigerant passing through the side holes 1462*b* may smoothly move to the second hole 1462*a* in which the flow path has an enlarged cross-sectional area. Alternatively, the inner diameter of each of the side holes 1462*b* may be the same as the inner diameter of the second hole 1462*a*. Accordingly, the refrigerant passing through the side holes 1462*b* may smoothly move to the second hole 1462*a* in which the area of the flow path is not reduced.

The inner diameter of the side hole 1462*b* may be larger than the inner diameter of the first hole 1462*c*. As a result, refrigerant passing between the compression chamber-side end portion 1462*a*1 of the valve body 1461 and the stepped portion 141*c*3 of the scroll-side back pressure hole 141*c* may move to the refrigerant pressing space R and then smoothly move to the second hole 1462*a* through the side hole 1462*b*.

Also, the inner diameter of the first hole 1462*c* may be smaller than the inner diameter C2*d* of the second scroll-side back pressure hole 141*c*2. Accordingly, when the back pressure valve 146 is seated on the stepped portion 141*c*3 of the scroll-side back pressure hole 141*c*, the compressed refrigerant that has moved from the compression chamber V to the second scroll-side back pressure hole 141*c*2 may be restricted from flowing into the first hole 1462*c* due to the reduced cross-sectional area of the flow path. The compressed refrigerant presses the compression chamber-side end portion 1462*a*1 of the valve body 1461 such that the valve body 1461 slides toward the back pressure chamber 160*a*.

The first hole 1462*c* may be formed through the compression chamber-side end portion 1462*a*1 of the extension body 1461*b*, and the second hole 1462*a* may be formed from the first hole 1462*c* up to the back pressure chamber-side end portion 1462*a*2 of the main body 1461*a*.

The back pressure valve 146 may include an inclined portion 1461*b*1 at which the valve body 1461, more specifically, the compression chamber-side end portion 1462*a*1 of the extension body 1461*b* is inclined. That is, the inclined portion 1461*b*1 may be formed on the valve body 1461 of the back pressure valve 146.

The inclined portion 1461*b*1 may be formed so that its outer diameter gradually decreases along a circumference of the first hole 1462*c*. In other words, the inclined portion 1461*b*1 may be inclined in a direction from the first hole 1462*c* toward the second scroll-side back pressure hole 141*c*2.

The inclined portion 1461*b*1 may be seated on the stepped portion 141*c*3 formed through the scroll-side back pressure hole 141*c*. The back pressure valve 146 may be stably supported in the scroll-side back pressure hole 141*c* by the inclined portion and the stepped portion which are inclined to correspond to each other. In addition, the inclined portion 1461*b*1 may be brought into close contact with the stepped portion 141*c*3 by the compressed refrigerant in the back pressure chamber 160*a*. Accordingly, the compressed refrigerant in the back pressure chamber 160*a* moves to the compression chamber V through a second refrigerant flow path described hereinafter.

Also, although not illustrated, according to another embodiment, the compression chamber-side end portion 1462*a*1 of the extension body 1461*b* may be formed flat without inclination. In this case, the stepped portion 141*c*3 formed in the scroll-side back pressure hole 141*c* may also be formed flat. Accordingly, the compression chamber-side end portion 1462*a*1 of the extension body 1461*b* may be stably seated on the stepped portion 141*c*3 and may also be brought into close contact with the stepped portion 141*c*3.

The back pressure valve 146 may include a plurality of refrigerant flow paths. That is, the plurality of refrigerant flow paths may be formed in the valve body 1461 of the back pressure valve 146.

More specifically, the valve body 1461 of the back pressure valve 146 may be inserted into the back pressure hole to perform a sliding motion, and may have a first refrigerant flow path that penetrates therethrough in the axial direction, and a second refrigerant flow path that sequentially penetrates through an outer surface and the inside thereof. Also, the plurality of holes 1462 of the back pressure valve 146 may be formed in the valve body 1461 to communicate with one another, and define the first refrigerant flow path and the second refrigerant flow path. The refrigerant flow paths may allow a variation of the flow path area of the back pressure hole along which the refrigerant moves.

First, the scroll compressor according to an embodiment may include a first refrigerant flow path defined through the valve body 1461 in the axial direction. The first refrigerant flow path is a passage defined through the inside of the valve body 1461 in the axial direction, and is defined in the valve body 1461 by the first hole 1462*c* and the second hole 1462*a* communicating with each other. More specifically, the first refrigerant flow path may be defined by the first hole 1462*c* and the second hole 1462*a* that communicate with each other from the compression chamber-side end portion 1462*a*1 to the back pressure chamber-side end portion 1462*a*2 of the valve body 1461.

The scroll compressor according to an embodiment may include the second refrigerant flow path defined sequentially through the outer surface and the inside of the valve body 1461. The second refrigerant flow path is defined by a space between the inner circumferential surface of the back pressure hole and the outer surface of the compression chamber-side end portion of the valve body 1461, the side hole 1462*b*, and the second hole 1462*a* communicating together. More specifically, the scroll compressor has the second refrigerant flow path defined sequentially through the refrigerant pressing space R defined on the outer surface of the valve body 1461 and the inside of the valve body 1461. In other words, the second refrigerant flow path is a passage extending sequentially through the refrigerant pressing space R formed on the outer surface of the valve body 1461, the side hole 1462*b* of the valve body 1461 (more specifically, the extension body 1461*b*), and the second hole 1462*a* of the valve body 1461. The refrigerant pressing space R is a space defined by the outer surface of the valve body 1461 (more specifically, the outer surface of the extension body 1461*b*), the pressing surface 1461*c*, and the inner circumferential surface of the back pressure hole (more specifically, the first scroll-side back pressure hole 141*c*1).

Hereinafter, a position to which the back pressure valve 146 moves and a movement path of refrigerant will be described with reference to FIGS. 3 and 8 to 11.

When the compressor is operated and pressure in the compression chamber V rises (when the pressure in the compression chamber V is higher than the pressure in the back pressure chamber 160*a*), compressed refrigerant in the compression chamber V moves to the second scroll-side back pressure hole 141*c*2 and then flows into the first hole 1462*c* formed in the compression chamber-side end portion 1462*a*1 of the back pressure valve 146 so as to press the circumference of the first hole 1462*c* (more specifically, the inclined portion 1461*b*1). A pressing force P of the refrigerant causes the back pressure valve 146 to slide inside of the first scroll-side back pressure hole 141*c*1 in a direction toward the back pressure chamber 160*a*. However, the back pressure valve 146 cannot move to the plate-side back pressure hole 1611*a* by the valve restricting portion 1611*b* (see FIG. 3). At this time, the compressed refrigerant that has passed through the second scroll-side back pressure hole 141*c*2 moves to the back pressure chamber 160*a* along the first refrigerant flow path and the second refrigerant flow path. More specifically, the compressed refrigerant in the compression chamber V passes through the second scroll-side back pressure hole 141*c*2, and moves to the back pressure chamber 160*a* sequentially via the first hole 1462*c* formed in the compression chamber-side end portion 1462*a*1 of the back pressure valve 146, and the second hole 1462*a* communicating with the first hole. In addition, the compressed refrigerant in the compression chamber V passes through the second scroll-side back pressure hole 141*c*2, and flows through the gap (that is, the gap formed between the outer surface of the inclined portion 1461*b*1 and the stepped portion 141*c*3) that is formed, as the back pressure valve 146 slides toward the back pressure chamber 160*a*. The refrigerant then smoothly moves toward the back pressure chamber 160*a* sequentially through the refrigerant pressing space R and the side hole 1462*b* and the second hole 1462*a* of the valve body 1461. The back pressure valve 146 does not interfere with an increase in pressure in the back pressure chamber 160*a* when the pressure in the compression chamber V rises.

When the compressor is stopped and pressure in the compression chamber V is lowered (when the pressure in the compression chamber V is lower than the pressure in the back pressure chamber 160*a*), the compressed refrigerant in the back pressure chamber 160*a* passes through the plate-side back pressure hole 1611*a*, and then flows into the second hole 1462*a* formed in the back pressure chamber-side end portion 1462*a*2 of the back pressure valve 146 while pressing the circumference of the second hole 1462*a*. The pressing force P of the refrigerant causes the back pressure valve 146 to slide toward the compression chamber V inside of the first scroll-side back pressure hole 141*c*1, and the inclined portion 1461*b*1 formed on the compression chamber-side end portion 1462*a*1 of the back pressure valve 146 is seated on the stepped portion 141*c*3. At this time, the compressed refrigerant that has passed through the plate-side back pressure hole 1611*a* moves to the compression chamber V along the first refrigerant flow path, but does not move toward the compression chamber V along the second refrigerant flow path because the inclined portion 1461*b*1 of the back pressure valve 146 is brought into close contact with the stepped portion 141*c*3 of the scroll-side back pressure hole 141*c*. More specifically, the compressed refrigerant in the back pressure chamber 160*a* passes through the plate-side back pressure hole 1611*a* and moves to the compression chamber V sequentially through the second hole 1462*a* formed in the back pressure chamber-side end portion 1462*a*2 of the back pressure valve 146, and the first hole 1462*c* communicating with the second hole 1462*a* (the first refrigerant flow path is open). As the inclined portion 1461*b*1 of the back pressure valve 146 and the stepped portion 141*c*3 of the scroll-side back pressure hole 141*c* are brought into close contact with each other, the compressed refrigerant introduced into the second hole 1462*a* of the back pressure valve 146 does not flow into the side hole 1462*b* of the valve body 1461 (the second refrigerant flow path is closed) but flows into the first hole 1462*c* to move to the compression chamber V (the first refrigerant flow path is open). Accordingly, an amount of refrigerant moving into the compression chamber V is reduced due to the reduction in cross-sectional area of the flow path, and thus, the pressure in the back pressure chamber 160*a* is slowly lowered. The back pressure valve 146 suppresses or prevents (improves) pressure pulsation in the back pressure chamber 160*a* when the pressure in the compression chamber V is lowered.

In the scroll compressor according to another embodiment, the back pressure valve 146 may be disposed not inside of the scroll-side back pressure hole 141*c* as described above, but inside of the plate-side back pressure hole 1611*a*. The back pressure valve 146 may move inside of the plate-side back pressure hole 1611*a*. This embodiment will be described in the back pressure chamber assembly 160 described hereinafter.

The non-orbiting wrap 142 of the non-orbiting scroll 140 may extend from a lower surface of the non-orbiting end plate 141 facing the orbiting scroll 150 by a set or predetermined height in the axial direction of the rotational shaft 125, while spirally wrapping several times toward the side wall portion 143 in a vicinity of the discharge port 141*a*. The non-orbiting wrap 142 may be formed to correspond to orbiting wrap 152 described hereinafter, so as to define a pair of compression chambers V with the orbiting wrap 152.

The non-orbiting side wall portion 143 may be formed in an annular shape by extending in the axial direction of the rotational shaft 125 from a lower edge of the non-orbiting end plate 141 to surround the non-orbiting wrap 142. A suction port may be radially formed through one side of an outer circumferential surface of the non-orbiting side wall portion 143.

For example, the suction port may be formed in an arcuate shape that extends by a preset or predetermined length between a plurality of guide protrusions 144 described hereinafter in the circumferential direction. Accordingly, refrigerant suctioned through the refrigerant suction pipe 117 may be rapidly suctioned into the suction port 143*a* via the guide protrusions 144.

The non-orbiting scroll 140 may include guide protrusions 144 disposed on one side surface of the main frame 130 with the orbiting scroll 150 interposed therebetween, and extend from an outer circumferential surface (or outer surface) of the main frame 130 in the radial direction, and accordingly, may be movably supported in the axial direction with respect to the main frame 130.

A guide insertion hole 144*a* may be formed through the guide protrusion 144 in the axial direction of the rotational shaft 125, and a guide bush 137 that guides an axial movement of the non-orbiting scroll 140 may be inserted into the guide insertion hole 144*a* to be supported on the main frame 130.

The guide protrusion 144 may extend in the radial direction from an outer circumferential surface of a lower side of the non-orbiting side wall portion 143. The guide protrusion 144 may be formed in a single annular shape or may be provided as a plurality disposed at preset or predetermined distances in the circumferential direction. An example in which the plurality of guide protrusions 144 is formed at preset distances along the circumferential direction will be described.

The guide insertion holes 144*a* may be formed through the plurality of guide protrusions 144, respectively, in the axial direction of the rotational shaft 125. The guide insertion holes 144*a* may be coaxially located with bolt fastening holes 136*a* formed in the frame fixing portion 136 of the main frame 130. The guide bushes 137 may be inserted into the guide insertion holes 144*a* to be supported on an upper surface of the frame fixing portion 136 in the axial direction of the rotational shaft 125.

Key grooves into which keys of the Oldham ring 170 may be slidably inserted in the radial direction may be formed in some of the guide protrusions 144 among the plurality of guide protrusions 144 (not illustrated).

Hereinafter, the non-orbiting scroll will be described.

The orbiting scroll 150 may be disposed between the main frame 130 and the non-orbiting scroll 140, and perform an orbiting motion by being supported on the main frame 130 in the axial direction of the rotational shaft 125. More specifically, the orbiting scroll 150 may be coupled to the rotational shaft 125 and disposed on the upper surface of the main frame 130. The Oldham ring 170 as an anti-rotation mechanism may be disposed between the orbiting scroll 150 and the main frame 130. Accordingly, the orbiting scroll 150 may perform an orbiting motion relative to the non-orbiting scroll 140 while its rotational motion is restricted.

The orbiting scroll 150 according to an embodiment may include orbiting end plate 151, orbiting wrap 152, and rotational shaft coupling portion 153. The orbiting end plate 151 may be formed in a disk shape. The orbiting end plate 151 may be supported by the scroll support portion 134 of the main frame 130 in the axial direction of the rotational shaft 125. Thus, the orbiting end plate 151 and the scroll support portion 134 facing it form an axial bearing surface (no reference numeral given).

A groove into which another key of the Oldham ring 170 is slidably inserted may be formed in a lower surface of the orbiting end plate 151 (not illustrated).

The orbiting wrap 152 may be engaged with the non-orbiting wrap 142 to define the compression chamber V. The orbiting wrap 152 may be formed in a spiral shape by protruding from an upper surface of the orbiting end plate 151 facing the non-orbiting scroll 140 by a preset or predetermined height. The orbiting wrap 152 may be formed to correspond to the non-orbiting wrap 142 of the non-orbiting scroll 140 and perform the orbiting motion while being engaged with the non-orbiting wrap 142.

The rotational shaft coupling portion 153 may protrude from a lower surface of the orbiting end plate 151 toward the main frame 130. The rotational shaft coupling portion 153 may have an inner circumferential surface formed in a cylindrical shape, so that an orbiting bearing (not illustrated) configured as a bush bearing may be press-fitted thereto.

A sliding bush 155 may be rotatably inserted into the orbiting bearing, and an eccentric pin portion or pin 125*a* of the rotational shaft 125 may be slidably inserted into the sliding bush 155. Accordingly, the rotational force of the drive motor 120 may be transmitted to the rotational shaft coupling portion 153 through the eccentric pin portion 125*a* of the rotational shaft 125 and the sliding bush 155. The rotational force transmitted to the rotational shaft coupling portion 153 may be restricted by the Oldham ring 170 and allow the orbiting scroll 150 to perform the orbiting motion.

The eccentric pin portion 125*a* and the sliding bush 155 may slide in the radial direction due to a difference between a centrifugal force generated by the orbiting scroll 150 and the pressure in the compression chamber V, and thus, an orbiting radius of the orbiting scroll 150 may vary. Through this, when over compression occurs in the compression chamber V, the over compression may be solved by allowing leakage between the compression chambers V, thereby preventing wrap damage in advance.

Hereinafter, the back pressure chamber assembly will be described.

The back pressure chamber assembly 160 according to an embodiment illustrated in FIG. 1 may be disposed between the high/low pressure separation plate 115 and the non-orbiting scroll 140 and include a back pressure chamber 160*a* formed in an annular shape. More specifically, the back pressure chamber assembly 160 may be disposed on an upper side of the non-orbiting scroll 140. Accordingly, a back pressure of the back pressure chamber 160*a* (more specifically, a force the back pressure applies to the back pressure chamber 160*a*) is applied to the non-orbiting scroll 140. In other words, the non-orbiting scroll 140 is pressed toward the orbiting scroll 150 by the back pressure to seal the compression chamber V.

The back pressure chamber assembly 160 according to an embodiment may include back pressure plate 161 and floating plate 165. The back pressure plate 161 may be coupled to an upper surface of the non-orbiting end plate 141. The floating plate 165 may be slidably coupled to the back pressure plate 161 to define the back pressure chamber 160*a* together with the back pressure plate 161.

The back pressure plate 161 may include a fixed plate portion 1611, a first annular wall portion or wall 1612, and a second annular wall portion or wall 1613. The fixed plate portion 1611 may be in the form of an annular plate with a hollow center.

Referring back to FIGS. 2 to 4, the back pressure chamber assembly 160, more specifically, the fixed plate portion 1611 may include a plate-side back pressure hole 1611*a* formed therethrough in the axial direction of the rotational shaft 125. The plate-side back pressure hole 1611*a* may be formed in the back pressure chamber assembly 160, more specifically, the fixed plate portion 1611 of the back pressure plate 161, and serve as a refrigerant flow path through which the back pressure chamber 160*a* and the scroll-side back pressure hole 141*c* communicate with each other.

The plate-side back pressure hole 1611*a* may penetrate from the back pressure chamber 160*a* in the direction in which the non-orbiting scroll 140 is disposed. The plate-side back pressure hole 1611*a* may communicate with the compression chamber V through the scroll-side back pressure hole 141*c*. Accordingly, the plate-side back pressure hole 1611*a* may communicate with the scroll-side back pressure hole 141*c* so that the compression chamber V and the back pressure chamber 160*a* may communicate with each other. During operation of the compressor, compressed refrigerant in the compression chamber V may move to the back pressure chamber 160*a* sequentially through the scroll-side back pressure hole 141*c* and the plate-side back pressure hole 1611*a*. When the operation of the compressor is stopped, the refrigerant in the back pressure chamber 160*a* may move to the compression chamber V sequentially through the plate-side back pressure hole 1611*a* and the scroll-side back pressure hole 141*c*.

The plate-side back pressure hole 1611*a* may penetrate from one surface of the back pressure chamber assembly 160 facing the non-orbiting scroll 140 to the back pressure chamber 160*a*. The one surface of the back pressure chamber assembly 160 indicates one surface of the fixed plate portion 1611, and the one surface of the fixed plate portion 1611 is a lower surface facing the non-orbiting scroll 140.

Central axis bc of the plate-side back pressure hole 1611*a* may be coaxial with central axis fc of the scroll-side back pressure hole 141*c* (see FIG. 3). Accordingly, the plate-side back pressure hole 1611*a* and the scroll-side back pressure hole 141*c* may communicate with each other, such that refrigerant may smoothly move along the plate-side back pressure hole 1611*a* and the scroll-side back pressure hole 141*c*.

An inner diameter of the plate-side back pressure hole 1611*a* may be smaller than an inner diameter of the scroll-side back pressure hole 141*c*. Due to this, one surface 1611*b* (the valve restricting portion 1611*b*) of the back pressure chamber assembly 160 may cover a portion of the scroll-side back pressure hole 141*c*.

When the back pressure valve 146 is disposed inside of the scroll-side back pressure hole 141*c*, the back pressure valve 146 axially overlaps the valve restricting portion 1611*b* that covers the scroll-side back pressure hole 141*c*. Accordingly, the valve restricting portion 1611*b* restricts movement of the back pressure valve 146. More specifically, the valve restricting portion 1611*b* allows the back pressure valve 146 to be movable only inside of the scroll-side back pressure hole 141*c* and restricts the back pressure valve 146 from moving out of the scroll-side back pressure hole 141*c* toward the plate-side back pressure hole 1611*a*.

According to another embodiment, the plate-side back pressure hole 1611*a* may be disposed to be eccentric from the scroll-side back pressure hole 141*c* but communicate with the scroll-side back pressure hole 141*c* (see FIG. 4). The central axis bc of the plate-side back pressure hole 1611*a* may be spaced apart from the central axis fc of the scroll-side back pressure hole 141*c* by the preset or predetermined distance e, and the plate-side back pressure hole 1611*a* may communicate with the scroll-side back pressure hole 1611*a*. In other words, a portion of the plate-side back pressure hole 1611*a* may communicate with a portion of the scroll-side back pressure hole 141*c*. That is, one surface 1611*b*' (valve restricting portion 1611*b*') of the back pressure chamber assembly 160 may coves a portion of the scroll-side back pressure hole 141*c*, and the back pressure valve 146 overlap the valve restricting portion 1611*b*' in the axial direction. The valve restricting portion 1611*b*' allows the back pressure valve 146 to be movable only inside of the scroll-side back pressure hole 141*c* and restricts the back pressure valve 146 from moving out of the scroll-side back pressure hole 141*c* toward the plate-side back pressure hole 1611*a*. The scroll-side back pressure hole 141*c* indicates, more specifically, first scroll-side back pressure hole 141*c*1. More specifically, the back pressure chamber assembly 160 represents the fixed plate portion 1611 of the back pressure plate 161.

Figure 12:
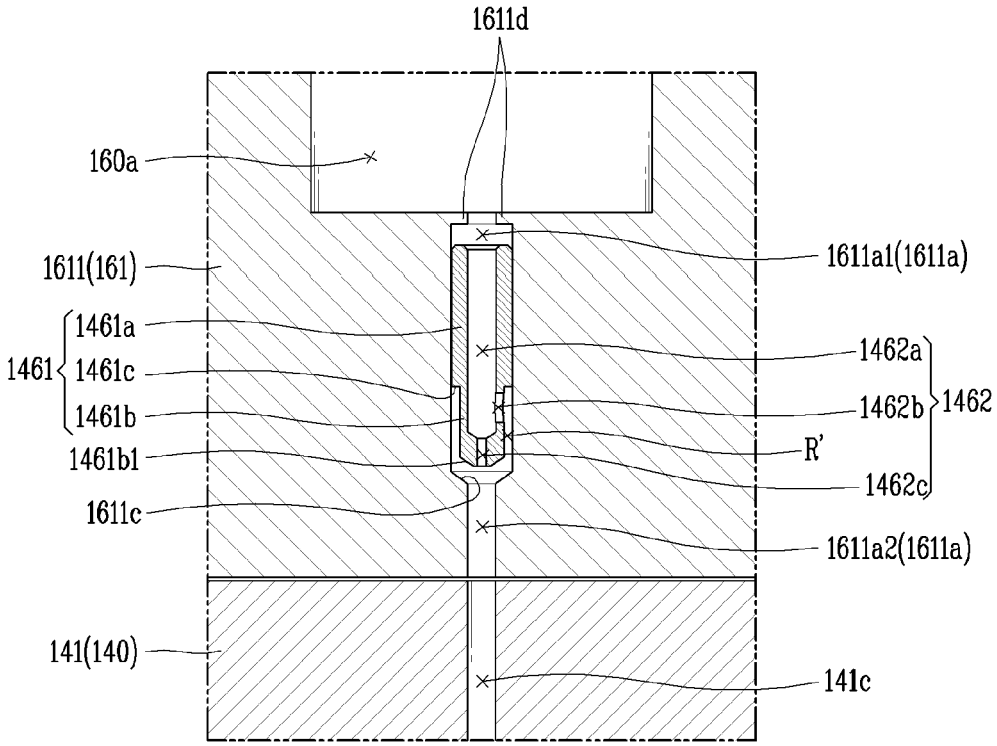
FIG. 12 is a longitudinal cross-sectional view schematically illustrating an embodiment in which the back pressure valve of FIG. 1 is disposed inside of the plate-side back pressure hole.
Figure 13:
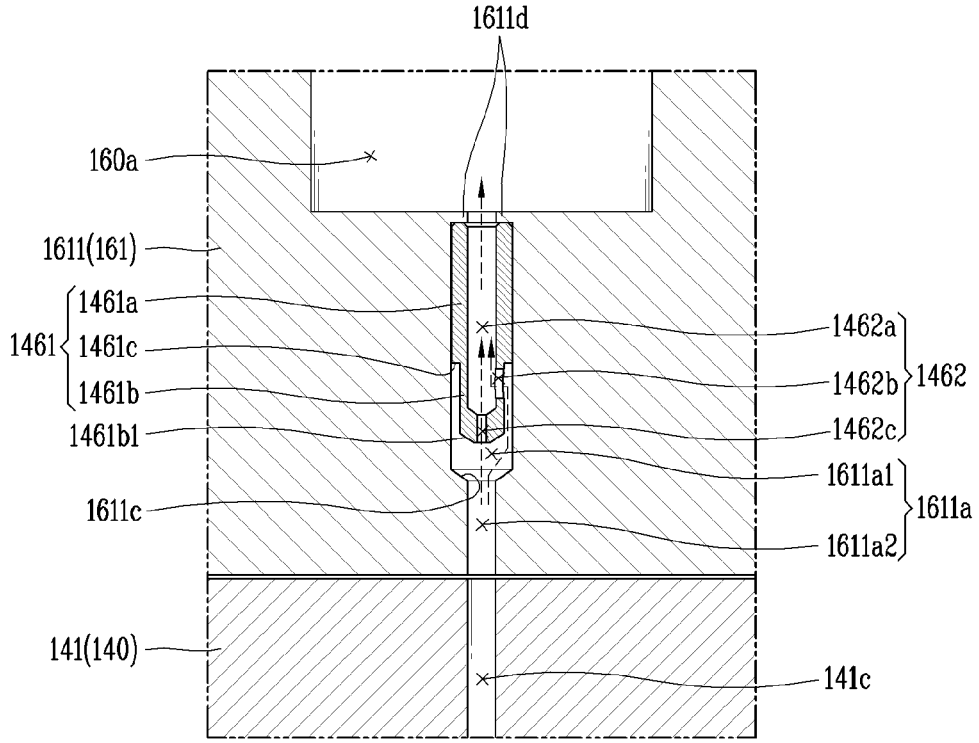
FIG. 13 is a longitudinal cross-sectional view illustrating a position of the back pressure valve and a movement path of refrigerant when pressure in the compression chamber increases in FIG. 12.
Figure 14:
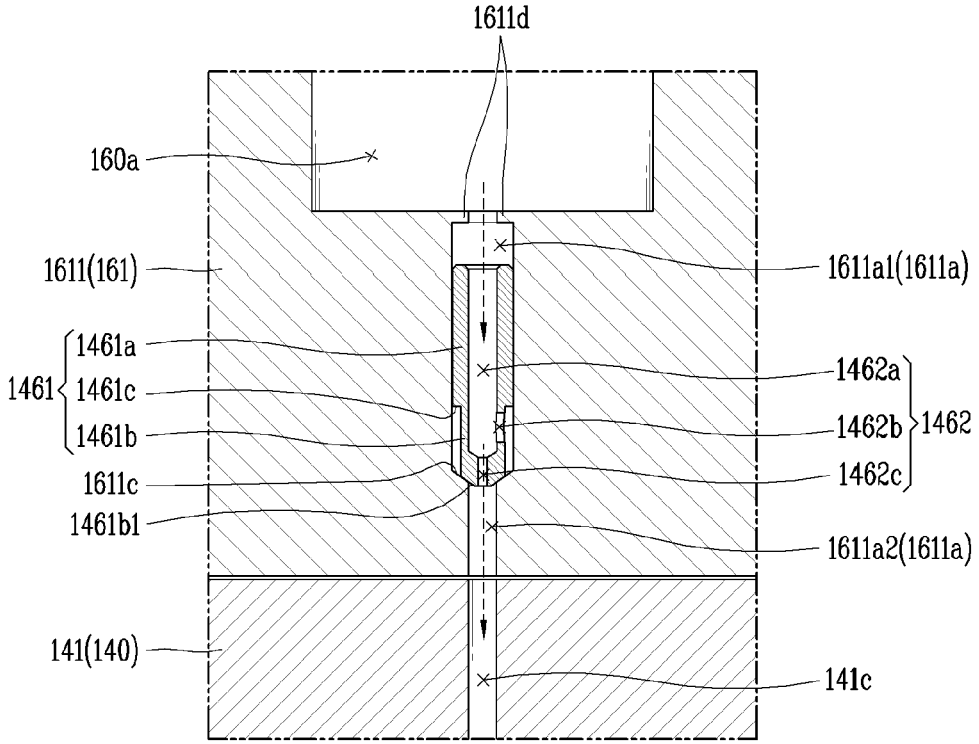
FIG. 14 is a longitudinal cross-sectional view illustrating a position of the back pressure valve and a movement path of refrigerant when pressure in the compression chamber decreases in FIG. 12.

In a scroll compressor according to still another embodiment, the back pressure valve 146 may be disposed not inside of the scroll-side back pressure hole 141*c* as described above, but inside of the plate-side back pressure hole 1611*a*. The back pressure valve 146 may move inside of the plate-side back pressure hole 1611*a*. FIGS. 12 to 14 illustrate still another embodiment in which the back pressure valve 146 is disposed inside of the plate-side back pressure hole 1611*a*.

Hereinafter, in describing the scroll compressor according to this embodiment illustrated in FIGS. 12 to 14, different components or parts compared to the scroll compressor according to the embodiments illustrated in FIGS. 1 to 11 will be described, and repetitive description of the same or similar components as those of the scroll compressor according to the embodiments illustrated in FIGS. 1 to 11 has been omitted.

Referring to FIGS. 12 to 14, the back pressure valve 146 may be disposed inside of the plate-side back pressure hole 1611*a*. The back pressure valve 146 may slide inside of the plate-side back pressure hole 1611*a*.

The plate-side back pressure hole 1611*a* may include a first plate-side back pressure hole 1611*a*1 that communicates with the back pressure chamber 160*a*, and a second plate-side back pressure hole 1611*a*2 having one or a first end portion communicating with the first plate-side back pressure hole 1611*a*1 and another or a second end portion communicating with the scroll-side back pressure hole 141*c*. More specifically, the first plate-side back pressure hole 1611*a*1 communicates with the back pressure chamber 160*a* and penetrates by a preset or predetermined depth from the back pressure chamber 160*a*. The second plate-side back pressure hole 1611*a*2 may penetrate from the first plate-side back pressure hole 1611*a*1 to one surface of the back pressure chamber assembly 160 facing the non-orbiting scroll 140. The one surface of the back pressure chamber assembly 160 indicates one surface of the fixed plate portion 1611, and the one surface of the fixed plate portion 1611 is the lower surface facing the non-orbiting scroll 140.

An inner diameter of the first plate-side back pressure hole 1611*a*1 may be larger than an inner diameter of the second plate-side back pressure hole 1611*a*2, and a plate-side stepped portion 1611*c* that restricts movement of the back pressure valve 146 may be formed between the first plate-side back pressure hole 1611*a*1 and the second plate-side back pressure hole 1611*a*2. More specifically, the plate-side stepped portion 1611*c* may be formed at a portion (boundary region) where the first plate-side back pressure hole 1611*a*1 and the second plate-side back pressure hole 1611*a*2 are connected to each other, and inclined in a direction toward the second plate-side back pressure hole 1611*a*2. For this reason, the back pressure valve 146 is movably disposed inside of the first plate-side back pressure hole 1611*a*1 and is seated on the plate-side stepped portion 1611*c*, to be restricted from moving toward the second plate-side back pressure hole 1611*a*2.

One or a first end portion of the first plate-side back pressure hole 1611*a*1 near the back pressure chamber 160*a* may be coupled with a plate-side valve restricting portion 1611*d* that restricts movement of the back pressure valve 146. The plate-side valve restricting portion 1611*d* may be configured as, for example, a c-ring or a drilled screw. After the back pressure valve 146 is inserted into the first plate-side back-pressure hole 1611*a*1, the plate-side valve restricting portion 1611*d* may be fastened to the one end portion of the first plate-side back pressure hole 1611*a*1, so that the back pressure valve 146 may slide inside of the first plate-side back pressure hole 1611*a*1 but cannot move toward the back pressure chamber 160*a* beyond the first plate-side back pressure hole 1611*a*1.

The plate-side valve restricting portion 1611*d* may include a through hole (not illustrated). The through hole refers to a through hole that is formed through, for example, a c-ring or a drilled screw. Accordingly, refrigerant moves to the back pressure chamber 160*a* or to the compression chamber V through the through hole.

Another or a second end portion of the second plate-side back pressure hole 1611*a*2 opposite to the back pressure chamber 160*a* may communicate with the scroll-side back pressure hole 141*c*.

Central axes of the first plate-side back pressure hole 1611*a*1 and the second plate-side back pressure hole 1611*a*2 may be coaxial with a central axis of the scroll-side back pressure hole 141*c*. Accordingly, the second plate-side back pressure hole 1611*a*2 and the scroll-side back pressure hole 141*c* may communicate with each other, such that refrigerant may smoothly move along the second plate-side back pressure hole 1611*a*2 and the scroll-side back pressure hole 141*c*.

An inner diameter of the second plate-side back pressure hole 1611*a*2 may be the same as an inner diameter of the scroll-side back pressure hole 141*c*. Accordingly, as there is no reduction in cross-sectional area of the flow path, refrigerant may move without interference. Alternatively, the inner diameter of the second plate-side back pressure hole 1611*a*2 may be larger than the inner diameter of the scroll-side back pressure hole 141*c*. Accordingly, compressed refrigerant in the compression chamber V may smoothly move to the second plate-side back pressure hole 1611*a*2 due to the increased cross-sectional area of the flow path. In addition, compressed refrigerant in the back pressure chamber 160*a* may be obstructed or blocked from flowing into the scroll-side back pressure hole due to the reduced cross-sectional area of the flow path, which reduces an amount of refrigerant moving to the compression chamber V so as to slowly lower the pressure of the back pressure chamber 160*a*, thereby suppressing or preventing pressure pulsation in the back pressure chamber 160*a*.

According to another embodiment, the first plate-side back pressure hole 1611*a*1 and the second plate-side back pressure hole 1611*a*2 may be disposed to be eccentric from the scroll-side back pressure hole 141*c*. In other words, one end portion of the second plate-side back pressure hole 1611*a*2 which is opposite to the back pressure chamber 160*a* may be formed to be eccentric from the scroll-side back pressure hole 141*c* and communicate with the scroll-side back pressure hole 141*c*. More specifically, the central axis of the second plate-side back pressure hole 1611*a*2 may be spaced apart from the central axis of the scroll-side back pressure hole 141*c* by a preset or predetermined distance, and the one end portion of the second plate-side back pressure hole 1611*a*2 may communicate with the scroll-side back pressure hole 141*c*.

The scroll compressor according to this embodiment may include the back pressure valve 146 that moves inside of the back pressure hole along a longitudinal direction of the back pressure hole by a pressure difference between the compression chamber V and the back pressure chamber 160*a*, to vary a flow path area of the back pressure hole. The flow path area represents an area of a refrigerant flow path through which refrigerant moves. The back pressure valve 146 may be disposed inside of the back pressure hole and move along the inside of the back pressure hole to change the area of the refrigerant flow path, thereby improving pressure pulsation in the back pressure chamber 160*a*.

The back pressure valve 146 may move while being inserted into the back pressure hole (more specifically, the plate-side back pressure hole 1611*a*). More specifically, the back pressure valve 146 may slide while being inserted in the back pressure hole (the plate-side back pressure hole 1611*a*). The plate-side back pressure hole 1611*a* indicates the first scroll-side back pressure hole 1611*a*1. That is, the back pressure valve 146 may be inserted into the first plate-side back pressure hole 1611*a*1 and slide along the longitudinal direction of the first plate-side back pressure hole 1611*a*1 so that an area of the refrigerant flow path may vary.

The back pressure valve 146 serves to suppress or prevent pressure pulsation in the back pressure chamber 160*a*. To elaborate, when the compressor is operated and pressure in the compression chamber V rises (when the pressure in the compression chamber V is higher than the pressure in the back pressure chamber 160*a*), the back pressure valve 146 operates to enlarge a space of the refrigerant flow path such that compressed refrigerant in the compression chamber V may easily move to the back pressure chamber 160*a*. When the compressor is stopped and pressure in the compression chamber V decreases (when pressure in the compression chamber V is lower than the pressure in the back pressure chamber 160*a*), the back pressure valve 146 operates to reduce the space of the refrigerant flow path such that the compressed refrigerant in the back pressure chamber 160*a* may easily move to the compression chamber V. Therefore, the back pressure valve 146 does not interfere with a pressure increase in the back pressure chamber 160*a* when the pressure in the compression chamber V rises, and suppresses or prevents the pressure pulsation in the back pressure chamber 160*a* when the pressure in the compression chamber V is lowered.

The back pressure valve 146 of the scroll compressor according to this embodiment is the same as the back pressure valve 146 of the scroll compressor according to the embodiments illustrated in FIGS. 1 to 11. Therefore, repetitive description of the back pressure valve 146 has been omitted.

A cross-sectional shape of the main body 1461*a* of the back pressure valve 146 may correspond to a cross-sectional shape of the first plate-side back pressure hole 1611*a*1. More specifically, a cross-sectional shape of an outer surface of the main body 1461*a* in the radial direction may correspond to a cross-sectional shape of the first plate-side back pressure hole 1611*a*1 in the radial direction. For example, when the cross-sectional shape of the first plate-side back pressure hole 1611*a*1 in the radial direction is circular, the cross-sectional shape of the outer surface of the main body 1461*a* in the radial direction may also be circular. Accordingly, when the first plate-side back pressure hole 1611*a*1 is formed in a cylindrical shape, the main body 1461*a* may be formed in a cylindrical shape having a preset length.

A diameter Ad of the main body 1461*a* may be smaller than the inner diameter of the first plate-side back pressure hole 1611*a*1 such that the main body 1461*a* may slide inside of the first plate-side back pressure hole 1611*a*1 along the longitudinal direction of the first plate-side back pressure hole 1611*a*1. However, a very minute gap may be present between the outer surface of the main body 1461*a* and the inner surface of the first plate-side back pressure hole 1611*a*1. Therefore, an amount of refrigerant moving through the gap may be negligibly smaller than an amount of refrigerant moving through the refrigerant flow path passing through the back pressure valve 146. Due to this, when the back pressure valve 146 moves along the longitudinal direction of the first plate-side back pressure hole 1611*a*1, the main body 1461*a* may serve as a guide.

A cross-sectional shape of the extension body 1461*b* of the back pressure valve 146 may correspond to a cross-sectional shape of the first plate-side back pressure hole 1611*a*1; however, embodiments are not limited thereto. In other words, a cross-sectional shape of an outer surface of the extension body 1461*b* in the radial direction may correspond to a cross-sectional shape of the first plate-side back pressure hole 1611*a*1 in the radial direction; however, embodiments are not limited thereto. For example, when the cross-sectional shape of the first plate-side back pressure hole 1611*a*1 in the radial direction is circular, the cross-sectional shape of the outer surface of the extension body 1461*b* in the radial direction may be circular. However, embodiments are not limited to the circular shape but may be formed in any shape other than the circular shape.

A diameter Bd of the extension body 1461*b* may be larger than an inner diameter of the second plate-side back pressure hole 1611*a*2. Due to this, the back pressure valve 146 cannot move into the second plate-side back pressure hole 1611*a*2. When the compressor is stopped and the pressure in the compression chamber V is lowered, the back pressure valve 146 is seated on the plate-side stepped portion 1611*c*, and is closely brought into contact with the plate-side stepped portion 1611*c* by the compressed refrigerant in the back pressure chamber 160*a*. Accordingly, an area of the refrigerant flow path is varied.

Also, the pressing surface 1461*c* of the back pressure valve 146 may be inclined in a direction toward the second plate-side back pressure hole 1611*a*2. However, embodiments are not limited thereto and may not be inclined. This may improve the efficiency of selecting the shape of the pressing surface 1461*c*.

The compressed refrigerant in the compression chamber A may be introduced into a space (referred to as 'refrigerant pressing space R') defined by the pressing surface 1461*c*, an inner circumferential surface of the first plate-side back pressure hole 1611*a*1, and the outer surface of the extension body 1461*b*. The introduced refrigerant presses the pressing surface 1461*c* such that the valve body 1461 slides toward the back pressure chamber 160*a* and is introduced into a side hole 1462*b* formed in the extension body 1461*b*, which will be described hereinafter.

In addition, the back pressure valve may be provided with one or more side holes 1462*b*. FIGS. 12 to 14 illustrate an embodiment including single side hole 1462*b*. Although not illustrated, two or more side holes 1462*b* may be formed.

The plurality of side holes 1462*b* may be formed through the side surface of the valve body 1461 (more specifically, the extension body 1461*b*) at an equal interval along a circumferential direction. Accordingly, the refrigerant may uniformly move to the refrigerant pressing space R', and uniformly press the pressing surface 1461*c*. In addition, in order to induce a smooth flow of the refrigerant, an inner diameter of each of the plurality of side holes 1462*b* may be smaller than an inner diameter of the second hole 1462*a* so that an amount of refrigerant passing through all of the plurality of side holes 1462*b* is controlled to be the same as or smaller than an amount of refrigerant passing through the second hole 1462*a*.

Also, the inner diameter of the first hole 1462*c* of the back pressure valve 146 may be smaller than the inner diameter of the second plate-side back pressure hole 1611*a*2. Accordingly, when the back pressure valve 146 is seated on the plate-side stepped portion 1611*c*, the compressed refrigerant that has moved from the compression chamber V to the second plate-side back pressure hole 1611*a*2 may be restricted from flowing into the first hole 1462*c* due to the reduced cross-sectional area of the flow path. The compressed refrigerant presses the compression chamber-side end portion 1462*a*1 of the valve body 1461 such that the valve body 1461 slides toward the back pressure chamber 160*a*.

In addition, the inclined portion 1461*b*1 of the back pressure valve 146 is seated on the plate-side stepped portion 1611*c*. Thus, the back pressure valve 146 may be stably supported by the plate-side back pressure hole 1611*a*. In addition, the inclined portion 1461*b*1 is brought into close contact with the plate-side stepped portion 1611*c* by the compressed refrigerant in the back pressure chamber 160*a*. Accordingly, the compressed refrigerant in the back pressure chamber 160*a* moves to the compression chamber V through a second refrigerant flow path described hereinafter.

The back pressure valve 146 may include a plurality of refrigerant flow paths. That is, the plurality of refrigerant flow paths may be formed in the valve body 1461 of the back pressure valve 146.

First, the scroll compressor according to this embodiment may include a first refrigerant flow path defined through the valve body 1461 in the axial direction. The first refrigerant flow path is defined by the first hole 1462*c* and the second hole 1462*a* that communicate with each other from the compression chamber-side end portion 1462*a*1 to the back pressure chamber-side end portion 1462*a*2 of the valve body 1461.

The scroll compressor according to this embodiment may include the second refrigerant flow path defined sequentially through the outer surface and the inside of the valve body 1461. More specifically, the scroll compressor has the second refrigerant flow path defined sequentially through the refrigerant pressing space R' formed on the outer surface of the valve body 1461 and the inside of the valve body 1461. In other words, the second refrigerant flow path is a passage sequentially penetrating through the refrigerant pressing space R' formed on the outer surface of the valve body 1461, the side hole 1462*b* of the valve body 1461 (more specifically, the extension body 1461*b*), and the second hole 1462*a* of the valve body 1461. The refrigerant pressing space R' is a space surrounded by the outer surface of the valve body 1461 (more specifically, the outer surface of the extension body 1461*b*), the pressing surface 1461*c*, and the inner circumferential surface of the back pressure hole (more specifically, the first plate-side back pressure hole 1611*a*1).

Hereinafter, a position to which the back pressure valve 146 moves and a moving path of refrigerant will be described with reference to FIGS. 12 to 14.

When the compressor is operated and the pressure in the compression chamber V rises (when the pressure in the compression chamber V is higher than the pressure in the back pressure chamber 160*a*), the compressed refrigerant in the compression chamber V moves sequentially along the scroll-side back pressure hole 141*c* and the second plate-side back pressure hole 1611*a*2 and then flows into the first hole 1462*c* formed in the compression chamber-side end portion 1462*a*1 of the back pressure valve 146 so as to press the circumference of the first hole 1462*c* (more specifically, the inclined portion 1461*b*1). A pressing force of the refrigerant causes the back pressure valve 146 to slide inside of the first plate-side back pressure hole 1611*a*1 in a direction toward the back pressure chamber 160*a*. However, the back pressure valve 146 cannot move to the back pressure chamber 160*a* by the valve restricting portion 1611*d*. At this time, the compressed refrigerant that has passed through the second plate-side back pressure hole 1611*a*2 moves to the back pressure chamber 160*a* along the first refrigerant flow path and the second refrigerant flow path. More specifically, the compressed refrigerant in the compression chamber V passes through the second plate-side back pressure hole 1611*a*2, and moves to the back pressure chamber 160*a* sequentially via the first hole 1462*c* formed in the compression chamber-side end portion 1462*a*1 of the back pressure valve 146, and the second hole 1462*a* communicating with the first hole 1462*c*. In addition, the compressed refrigerant in the compression chamber V passes through the second plate-side back pressure hole 1611*a*2, and flows through the gap (that is, the gap formed between the outer surface of the inclined portion 1461*b*1 and the plate-side stepped portion 1611*c*) that is formed as the back pressure valve 146 slides toward the back pressure chamber 160*a*. The refrigerant then smoothly moves toward the back pressure chamber 160*a* sequentially through the refrigerant pressing space R' and the side hole 1462*b* and the second hole 1462*a* of the valve body 1461. The back pressure valve 146 does not interfere with an increase in pressure in the back pressure chamber 160*a* when the pressure in the compression chamber V rises.

When the compressor is stopped and the pressure in the compression chamber V is lowered (when the pressure in the compression chamber V is lower than the pressure in the back pressure chamber 160*a*), the compressed refrigerant in the back pressure chamber 160*a* flows into the second hole 1462*a* formed in the back pressure chamber-side end portion 1462*a*2 of the back pressure valve 146 while pressing the circumference of the second hole 1462*a*. The pressing force of the refrigerant causes the back pressure valve 146 to slide toward the compression chamber V inside of the first plate-side back pressure hole 1611*a*1, and the inclined portion 1461*b*1 formed on the compression chamber-side end portion 1462*a*1 of the back pressure valve 146 is seated on the plate-side stepped portion 1611*c*. At this time, the compressed refrigerant of the back pressure chamber 160*a* moves to the compression chamber V along the first refrigerant flow path, but is restricted from moving to the compression chamber V because the inclined portion 1461*b*1 of the back pressure valve 146 and the plate-side stepped portion 1611*c* are brought into close contact with each other. More specifically, the compressed refrigerant of the back pressure chamber 160*a* moves to the compression chamber V sequentially through the second hole 1462*a* formed in the back pressure chamber-side end portion 1462*a*2 of the back pressure valve 146, and the first hole 1462*c* communicating with the second hole 1462*a* (the first refrigerant flow path open). As the inclined portion 1461*b*1 of the back pressure valve 146 and the plate-side stepped portion 1611*c* are brought into close contact with each other, the compressed refrigerant introduced into the second hole 1462*a* of the back pressure valve 146 does not flow into the side hole 1462*b* of the valve body 1461 (the second refrigerant flow path closed), flows into the first hole 1462*c*, and then moves to the compression chamber V (the first refrigerant flow path open). Accordingly, an amount of refrigerant moving into the compression chamber V is reduced due to the reduction in the cross-sectional area of the flow path, and thus, the pressure in the back pressure chamber 160*a* is slowly lowered. The back pressure valve 146 suppresses or prevents (improves) pressure pulsation in the back pressure chamber 160*a* when the pressure in the compression chamber V is lowered.

The first annular wall portion 1612 and the second annular wall portion 1613 may be formed on an upper surface of the fixed plate portion 1611 to surround inner and outer circumferential surfaces of the fixed plate portion 1611. Accordingly, an outer circumferential surface of the first annular wall portion 1612, an inner circumferential surface of the second annular wall portion 1613, the upper surface of the fixed plate portion 1611, and a lower surface of the floating plate 165 may define the back pressure chamber S in the annular shape.

The first annular wall portion 1612 may include an intermediate discharge port 1612*a* that communicates with the discharge port 141*a* of the non-orbiting scroll 140. The valve guide groove 1612*b* into which a check valve (hereinafter, referred to as a "discharge valve") 145 is slidably inserted may be formed at an inner side of the intermediate discharge port 1612*a*. The backflow prevention hole 1612*c* may be formed in a central portion of the valve guide groove 1612*b*. Accordingly, the check valve 145 may be selectively opened and closed between the discharge port 141*a* and the intermediate discharge port 1612*a* to suppress or prevent discharged refrigerant from flowing back into the compression chamber V.

The floating plate 165 may be formed in an annular shape and may be formed of a lighter material than the back pressure plate 161, for example. Accordingly, the floating plate 165 may be detachably coupled to a lower surface of the high/low pressure separation plate 115 while moving in the axial direction with respect to the back pressure plate 161 depending on the pressure of the back pressure chamber 160*a*. For example, when the floating plate 165 is brought into contact with the high/low pressure separation plate 115, the floating plate 165 may serve to seal the low-pressure portion 110*a* such that the discharged refrigerant is discharged to the high-pressure portion 110*b* without leaking into the low pressure portion 110*a*.

The scroll compressor according to embodiments described above operates as follows.

When power is applied to the stator coil 1212 of the stator 121, the rotor 122 rotates together with the rotational shaft 125. Then, the orbiting scroll 150 coupled to the rotational shaft 125 performs the orbiting motion with respect to the non-orbiting scroll 140, forming a pair of compression chambers V between the orbiting wrap 152 and the non-orbiting wrap 142.

The compression chambers V gradually decrease in volume while moving from outside to inside according to the orbiting motion of the orbiting scroll 150. At this time, refrigerant is suctioned into the low-pressure portion 110*a* of the casing 110 through the refrigerant suction pipe 117. Some of this refrigerant is suctioned directly into suction pressure chambers (no reference numeral given) of the compression chambers V, respectively, while the remaining refrigerant first flows toward the drive motor 120 to cool the drive motor 120 and then is suctioned into the suction pressure chambers (no reference numeral given).

The refrigerant suctioned into each suction pressure chamber (no reference numeral given) is compressed while moving toward the intermediate pressure chamber and the discharge pressure chamber (no reference numeral given) along a movement path of the compression chamber V. The refrigerant moved to the discharge pressure chamber (no reference numeral given) is discharged to the high-pressure portion 110*b* through the discharge port 141*a* and the intermediate discharge port 1612*a* while pushing the discharge valve 145. The refrigerant is filled in the high-pressure portion 110*b* and then discharged through a condenser of a refrigeration cycle via the refrigerant discharge pipe 118. The series of processes is repeatedly carried out.

A portion of the refrigerant compressed while passing through each intermediate pressure chamber V12 is bypassed in advance toward the high-pressure portion 110*b* from the intermediate pressure chamber (no reference numeral given) defining each compression chamber V, through the bypass hole 141*b* before reaching the discharge port 141*a*. This may suppress or prevent the refrigerant from being over compressed over a preset or predetermined pressure or more in the compression chamber V.

In addition, another portion of the refrigerant compressed while passing through the intermediate pressure chamber (no reference numeral given) also moves to the back pressure chamber 160*a* through the scroll-side back pressure hole 141*c* before reaching the discharge port 141*a*, so that intermediate pressure may be formed in the back pressure chamber 160*a*. Then, the floating plate 165 moves up toward the high/low pressure separation plate 115 to be in close contact with the sealing plate 1151 disposed on the high/low pressure separation plate 115. The back pressure plate 161 is accordingly moved down by the pressure of the back pressure chamber 160*a* applied toward the non-orbiting scroll 140, thereby pressing the non-orbiting scroll 140 toward the orbiting scroll 150.

As the floating plate 165 moves up and comes into close contact with the sealing plate 1151, the high-pressure portion 110*b* of the casing 110 is separated from the low-pressure portion 110*a*, to prevent the refrigerant discharged from each compression chamber V to the high-pressure portion 110*b* from flowing back into the low-pressure portion 110*a*. On the other hand, as the back pressure plate 161 is moved down toward the non-orbiting scroll 140, the non-orbiting scroll 140 is brought into close contact with the orbiting scroll 150. This may prevent the compressed refrigerant from leaking into a low-pressure side compression chamber from a high-pressure side compression chamber forming the intermediate pressure chamber.

During the operation of the scroll compressor, the related art scroll compressor does not have a component for adjusting back pressure in a refrigerant flow path providing communication between the compression chamber V and the back pressure chamber 160*a*. This continuously causes pulsation in the back pressure chamber 160*a*.

Therefore, in the scroll compressor according to embodiments, the back pressure valve 146 is disposed inside of the scroll-side back pressure hole 141*c* or the plate-side back pressure hole 1611*a*, which is the refrigerant flow path, to vary the flow path area of the scroll-side back pressure hole 141*c* or the plate-side back pressure hole 1611*a*. Accordingly, when the compressor is stopped and pressure in the compression chamber V decreases, compressed refrigerant of the back pressure chamber 160*a* may move to the compression chamber V through the first hole 1462*c* and the second hole 1462*a* of the back pressure valve 146 (the first refrigerant flow path), which communicate with each other, thereby suppressing or preventing (improving) pressure pulsation in the back pressure chamber 160*a*.

Figure 15:
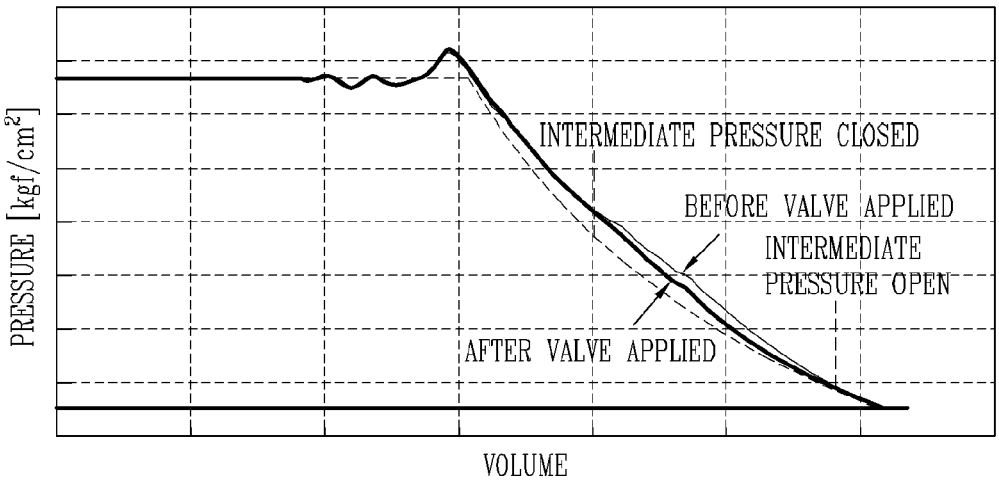
FIG. 15 is a view illustrating a change in pressure in a back pressure chamber of a scroll compressor to which a back pressure valve according to embodiments is applied and a back pressure chamber in a scroll compressor to which the back pressure valve is not applied.
Figure 16:
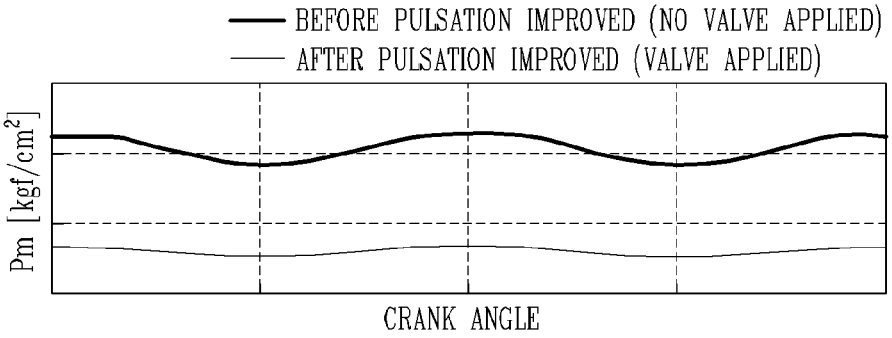
FIG. 16 is a view illustrating a change in pressure according to a crank angle in FIG. 15.

FIGS. 15 and 16 show pressure pulsation of a scroll compressor to which the back pressure valve 146 according to embodiments is applied. For reference, it can be seen that the pulsation in the back pressure chamber 160*a* has been improved during the operation of the scroll compressor according to embodiments in which the back pressure valve 146 is disposed in the scroll-side back pressure hole 141*c* (more specifically, the first scroll-side back pressure hole 141*c*1).

Referring to FIGS. 15 and 16, it can be seen that the pressure in the back pressure chamber 160*a* when the back pressure valve 146 is applied is lower than that when the back pressure valve 146 is not applied in a section where intermediate pressure is closed and open. As a result, it can be confirmed that the pressure pulsation is suppressed because an amplitude of the pressure in the back pressure chamber 160*a* according to a crank angle is lowered.

Embodiments disclosed herein provide a scroll compressor capable of improving pressure pulsation in a back pressure chamber by disposing a back pressure valve in a refrigerant flow path providing communication between a compression chamber and a back pressure chamber in a non-orbiting back pressure type scroll compressor.

Embodiments disclosed herein provide a scroll compressor that may include a casing, a high/low pressure separation plate, a main frame, an orbiting scroll, a non-orbiting scroll, a back pressure chamber assembly, and a back pressure hole. The high/low pressure separation plate may be fixed to an inside of a casing and partition a low-pressure part or portion defining a suction space and a high-pressure part or portion defining a discharge space. The main frame may be fixed inside of the casing and may be disposed in the low-pressure part. The orbiting scroll may be supported on the main frame in an axial direction and perform an orbiting motion. The non-orbiting scroll may be disposed to be movable relative to one side surface of the main frame in the axial direction with the orbiting scroll interposed therebetween, and may form a compression chamber together with the orbiting scroll. The back pressure chamber assembly may be disposed between the high/low pressure separation plate and the non-orbiting scroll and may have a back pressure chamber formed in an annular shape. The back pressure hole may be formed through the non-orbiting scroll and the back pressure chamber assembly such that the compression chamber and the back pressure chamber communicate with each other. A back pressure valve may be disposed inside of the back pressure hole. The back pressure valve may include a valve body disposed to be movable and extending in the axial direction, and holes formed through the valve body in the axial direction. The back pressure valve may move inside of the back pressure hole to vary a flow path area of the back pressure hole, thereby improving pressure pulsation in the back pressure chamber.

The holes of the back pressure valve may include a first hole and a second hole formed through the valve body in the axial direction. The first hole may be formed in a compression chamber-side end portion of the extension body. The second hole may communicate with the first hole, and extend from the first hole to a back pressure chamber-side end portion of the main body while an inner diameter thereof increases to be larger than an inner diameter of the first hole. A refrigerant flow path may be defined by the first hole and the second hole.

The back pressure valve may include a side hole formed in a side surface of the valve body. The side hole may communicate with the second hole and may be formed between the compression chamber-side end portion and the back pressure chamber-side end portion. An inner diameter of the side hole may be larger than an inner diameter of the first hole. Accordingly, refrigerant may move more easily toward the second hole through the side hole than the first hole.

The valve body may include a main body disposed on a side of the back pressure chamber, an extension body extending from the main body in the axial direction and disposed on a side of the compression chamber, and a pressing surface formed in a boundary region between the main body and the extension body. A cross-sectional area of the main body in a radial direction may be larger than a cross-sectional area of the extension body in the radial direction. With this configuration, a pressing force of compressed refrigerant may be applied to the pressing surface.

The first hole may be formed in a compression chamber-side end portion of the extension body. The second hole may extend from the first hole to a back pressure chamber-side end portion of the main body. The side hole may be formed in a side surface between the compression chamber-side end portion of the extension body and the pressing surface. Accordingly, a refrigerant flow path with a variable flow path area may be defined in the back pressure valve.

The valve body may include an inclined portion on which the compression chamber-side end portion of the extension body is formed to be inclined. The inclined portion may be formed such that an outer diameter thereof gradually decreases along a circumference of the first hole. Accordingly, the inclined portion may come into close contact with a stepped portion of a scroll-side back pressure hole that is inclined.

A back pressure valve may be disposed inside of the back pressure hole to move along a longitudinal direction of the back pressure hole by a pressure difference between the compression chamber and the back pressure chamber so that a flow path area of the back pressure hole may vary. This may suppress or prevent pressure pulsation in the back pressure chamber.

The back pressure valve may include a valve body extending in the axial direction and having a hollow shape, and a hole formed through an inside of the valve body in the axial direction. Refrigerant may flow through the hole of the back pressure valve and the valve body may be moved by a pressure difference of the refrigerant.

The back pressure valve may include a valve body and a plurality of holes. The valve body may be inserted into the back pressure hole to perform a sliding motion, and have a first refrigerant flow path penetrating therethrough in the axial direction, and a second refrigerant flow path penetrating sequentially through an outer surface and the inside thereof. The plurality of holes may be formed in the valve body to communicate with each other so as to define the first refrigerant flow path and the second refrigerant flow path. This may vary an area of a flow path of the back pressure hole through which refrigerant moves.

The valve body may include a main body disposed on the side of the back pressure chamber, an extension body extending from the main body in the axial direction and disposed on the side of the compression chamber, and a pressing surface formed in a boundary region between the main body and the extension body. With this configuration, a pressing force of compressed refrigerant may be applied to the pressing surface.

The plurality of holes may include a first hole formed in a compression chamber-side end portion of the valve body, a second hole communicating with the first hole and extending from the first hole to a back pressure chamber-side end portion of the valve body while an inner diameter thereof increases more than that of the first hole, and a side hole communicating with the second hole and formed between the compression chamber-side end portion and the back pressure chamber-side end portion. The plurality of holes may define refrigerant flow paths that vary in flow path area.

An inner diameter of the side hole may be larger than an inner diameter of the first hole. Accordingly, compressed refrigerant of the compression chamber may move to the back pressure chamber through the side hole with an enlarged flow path.

The valve body may include an inclined portion on which the compression chamber-side end portion of the extension body is formed to be inclined, and the inclined portion may have an outer diameter thereof gradually decreasing along a circumference of the first hole. Accordingly, the inclined portion may come into close contact with a stepped portion of a scroll-side back pressure hole that is inclined.

The first refrigerant flow path may be defined by the first hole and the second hole communicating with each other. The second refrigerant flow path may be defined by an inner circumferential surface of the back pressure hole, an outer surface of the compression chamber-side end portion, the side hole, and the second hole of the valve body that communicate with one another. This may vary an area of a flow path of the back pressure hole through which refrigerant moves.

The first refrigerant flow path and the second refrigerant flow path may be open when the pressure in the compression chamber is higher than the pressure in the back pressure chamber. Accordingly, the back pressure valve may not interfere with an increase in pressure in the back pressure chamber. The first refrigerant flow path may be open and the second refrigerant flow path may be closed when the pressure in the compression chamber is lower than the pressure in the back pressure chamber. Accordingly, an amount of refrigerant moving into the compression chamber may be reduced and the pressure in the back pressure chamber may be slowly lowered, pressure pulsation in the back pressure chamber may be suppressed or prevented.

The back pressure hole may include a scroll-side back pressure hole and a plate-side back pressure hole. The scroll-side back pressure hole may be formed in the non-orbiting scroll and communicate with the compression chamber. The plate-side back pressure hole may be formed in the back pressure chamber assembly and communicate with the scroll-side back pressure hole and the back pressure chamber. The back pressure valve may be disposed inside of the scroll-side back pressure hole to perform a sliding motion. With the configuration, pressure pulsation in the back pressure chamber may be suppressed or prevented.

A portion of the scroll-side back pressure hole may be covered by one surface of the back pressure chamber assembly, and the back pressure valve may axially overlap the one surface of the back pressure chamber assembly that covers the scroll-side back pressure hole. Accordingly, the back pressure valve may be restricted from moving to the plate-side back pressure hole beyond the scroll-side back pressure hole.

The scroll-side back pressure hole may include a first scroll-side back pressure hole and a second scroll-side back pressure hole. The first scroll-side back pressure hole may communicate with the plate-side back pressure hole, and the second scroll-side back pressure hole may have one or a first end portion communicating with the first scroll-side back pressure hole and another or a second end portion communicating with the compression chamber. An inner diameter of the first scroll-side back pressure hole may be larger than an inner diameter of the second scroll-side back pressure hole, and the back pressure valve may be inserted into the first scroll-side back pressure hole. Accordingly, the back pressure valve may be restricted from moving from the first scroll-side back pressure hole to the second scroll-side back pressure hole.

A stepped portion may be formed between the first scroll-side back pressure hole and the second scroll-side back pressure hole to restrict movement of the back pressure valve. The stepped portion may be inclined in a direction toward the second scroll-side back pressure hole. Accordingly, as the back pressure valve is seated on the stepped portion, movement to the second scroll-side back pressure hole may be restricted.

An inner diameter of the first hole may be smaller than an inner diameter of the second scroll-side back pressure hole. As a result, compressed refrigerant of the compression chamber may be restricted from flowing into the first hole due to the reduction in the cross-sectional area of the flow path, and thereby presses the compression chamber-side end portion of the valve body, so that the valve body may slide toward the back pressure chamber.

An inner diameter of the extension body may be larger than an inner diameter of the second scroll-side back pressure hole. Due to this, the back pressure valve cannot move into the second scroll-side back pressure hole.

The back pressure hole may include a scroll-side back pressure hole and a plate-side back pressure hole. The scroll-side back pressure hole may be formed in the non-orbiting scroll and communicate with the compression chamber. The plate-side back pressure hole may be formed in the back pressure chamber assembly and communicate with the scroll-side back pressure hole and the back pressure chamber. The back pressure valve may be disposed inside of the plate-side back pressure hole to perform a sliding motion. With the configuration, pressure pulsation in the back pressure chamber may be suppressed or prevented.

The plate-side back pressure hole may include a first plate-side back pressure hole and a second plate-side back pressure hole. The first plate-side back pressure hole may communicate with the back pressure chamber, and the second plate-side back pressure hole may have one or a first end portion communicating with the first plate-side back pressure hole and another or a second end portion communicating with the scroll-side back pressure hole. An inner diameter of the first plate-side back pressure hole may be larger than an inner diameter of the second plate-side back pressure hole, and the back pressure valve may be inserted into the first plate-side back pressure hole. Accordingly, the back pressure valve may be restricted from moving from the first plate-side back pressure hole to the second plate-side back pressure hole.

A plate-side stepped portion for restricting movement of the back pressure valve may be formed between the first plate-side back pressure hole and the second plate-side back pressure hole. The plate-side stepped portion may be inclined in a direction toward the second plate-side back pressure hole. Accordingly, as the back pressure valve is seated on the plate-side stepped portion, movement to the second plate-side back pressure hole may be restricted.

An inner diameter of the first hole may be smaller than an inner diameter of the second plate-side back pressure hole. As a result, compressed refrigerant of the compression chamber may be restricted from flowing into the first hole due to the reduction in the cross-sectional area of the flow path, and thereby presses the compression chamber-side end portion of the valve body, so that the valve body may slide toward the back pressure chamber.

An inner diameter of the extension body may be larger than an inner diameter of the plate-side back pressure hole. Due to this, the back pressure valve cannot move into the second plate-side back pressure hole.

A plate-side valve restricting portion that restricts movement of the back pressure valve may be fastened to one end portion facing the back pressure chamber, of both end portions of the first plate-side back pressure hole. This may restrict the back pressure valve from moving into the back pressure chamber beyond the second plate-side back pressure hole.

A scroll compressor according to embodiments disclosed herein may include a back pressure valve that is movable inside of a back pressure hole, through which a compression chamber and a back pressure chamber communicate with each other, to vary a flow path area of the back pressure hole. This may improve pressure pulsation in the back pressure chamber. In addition, in the scroll compressor according to embodiments disclosed herein, as the back pressure valve has a simple and light structure and is configured as a single body, an effect of improving assembly convenience and structural reliability may be achieved.

It will be understood that when an element or layer is referred to as being "on" another element or layer, the element or layer can be directly on another element or layer or intervening elements or layers. In contrast, when an element is referred to as being "directly on" another element or layer, there are no intervening elements or layers present. As used herein, the term "and/or" includes any and all combinations of one or more of the associated listed items.

It will be understood that, although the terms first, second, third, etc., may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section could be termed a second element, component, region, layer or section without departing from the teachings of the present invention.

Spatially relative terms, such as "lower", "upper" and the like, may be used herein for ease of description to describe the relationship of one element or feature to another element(s) or feature(s) as illustrated in the figures. It will be understood that the spatially relative terms are intended to encompass different orientations of the device in use or operation, in addition to the orientation depicted in the figures. For example, if the device in the figures is turned over, elements described as "lower" relative to other elements or features would then be oriented "upper" relative to the other elements or features. Thus, the exemplary term "lower" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Embodiments of the disclosure are described herein with reference to cross-section illustrations that are schematic illustrations of idealized embodiments (and intermediate structures) of the disclosure. As such, variations from the shapes of the illustrations as a result, for example, of manufacturing techniques and/or tolerances, are to be expected. Thus, embodiments of the disclosure should not be construed as limited to the particular shapes of regions illustrated herein but are to include deviations in shapes that result, for example, from manufacturing.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A scroll compressor, comprising:

a casing;

a high/low pressure separation plate that is fixed to an inside of the casing and partitions a low-pressure portion defining a suction space and a high-pressure portion defining a discharge space;

a main frame fixed to the inside of the casing and disposed in the low-pressure portion;

an orbiting scroll supported on the main frame in an axial direction of the scroll compressor to perform an orbiting motion;

a non-orbiting scroll that is movable relative to one side surface of the main frame in the axial direction with the orbiting scroll interposed therebetween and forms a compression chamber together with the orbiting scroll;

a back pressure chamber assembly disposed between the high/low pressure separation plate and the non-orbiting scroll and having a back pressure chamber formed in an annular shape; and at least one back pressure hole formed through the non-orbiting scroll and a fixed back pressure plate of the back pressure chamber assembly such that the compression chamber and the back pressure chamber communicate with each other, wherein the at least one back pressure hole comprises a scroll-side back pressure hole that is formed in the non-orbiting scroll and communicates with the compression chamber, and a plate-side back pressure hole that is formed in the fixed back pressure plate of the back pressure chamber assembly and communicates with the scroll-side back pressure hole and the back pressure chamber, wherein a back pressure valve is disposed inside of the scroll-side back pressure hole to perform a sliding motion, and wherein the back pressure valve includes a valve body that is movable and extends in the axial direction, and a plurality of holes formed through the valve body in the axial direction.

2. The scroll compressor of claim 1, wherein the plurality of holes of the back pressure valve comprises:

a first hole formed in a compression chamber-side end portion of the valve body; and a second hole that communicates with the first hole and extends from the first hole to a back pressure chamber-side end portion of the valve body, wherein an inner diameter of the second hole is larger than an inner diameter of the first hole.

3. The scroll compressor of claim 2, wherein the back pressure valve includes a side hole that communicates with the second hole and is formed between the compression chamber-side end portion and the back pressure chamber-side end portion, and wherein an inner diameter of the side hole is larger than the inner diameter of the first hole.

4. The scroll compressor of claim 1, wherein the valve body comprises:

a main body disposed on a side of the back pressure chamber;

an extension body that extends from the main body in the axial direction and disposed on a side of the compression chamber; and a pressing surface formed in a boundary region between the main body and the extension body, and wherein a cross-sectional area of the main body in a radial direction of the scroll compressor is larger than a cross-sectional area of the extension body in the radial direction.

5. The scroll compressor of claim 4, wherein the plurality of holes of the back pressure valve include a first hole and a second hole, wherein the first hole is formed in a compression chamber-side end portion of the extension body, wherein the second hole communicates with the first hole and extends from the first hole to a back pressure chamber-side end portion of the main body, and wherein an inner diameter of the second hole is larger than an inner diameter of the first hole.

6. The scroll compressor of claim 5, wherein the back pressure valve includes a side hole formed in a side surface of the valve body, wherein the side hole communicates with the second hole and is formed in the side surface between the compression chamber-side end portion of the extension body and the pressing surface, and wherein an inner diameter of the side hole is larger than the inner diameter of the first hole.

7. The scroll compressor of claim 5, wherein the valve body comprises an inclined portion on the compression chamber-side end portion of the extension body, and wherein the inclined portion is formed such that an outer diameter of the inclined portion gradually decreases toward a circumference of the first hole.

8. The scroll compressor of claim 5, wherein the scroll-side back pressure hole comprises:

a first scroll-side back pressure hole that communicates with the plate-side back pressure hole and a second scroll-side back pressure hole having a first end portion that communicates with the first scroll-side back pressure hole and a second end portion that communicates with the compression chamber, wherein an inner diameter of the first scroll-side back pressure hole is larger than an inner diameter of the second scroll-side back pressure hole, and wherein the back pressure valve is inserted into the first scroll-side back pressure hole.

9. The scroll compressor of claim 8, wherein a stepped portion is formed between the first scroll-side back pressure hole and the second scroll-side back pressure hole to restrict movement of the back pressure valve, and wherein the stepped portion is inclined in a direction toward the second scroll-side back pressure hole.

10. The scroll compressor of claim 8, wherein the inner diameter of the first hole is smaller than the inner diameter of the second scroll-side back pressure hole.

11. The scroll compressor of claim 8, wherein an inner diameter of the extension body is larger than the inner diameter of the second scroll-side back pressure hole.

12. The scroll compressor of claim 1, wherein a portion of the scroll-side back pressure hole is covered by one surface of the back pressure chamber assembly, and wherein the back pressure valve axially overlaps the one surface of the back pressure chamber assembly that covers the scroll-side back pressure hole.

13. The scroll compressor of claim 1, wherein a length of the at least one back pressure hole from a first end at the compression chamber to a second end at the back pressure chamber is coaxially aligned with a central axis.

14. A scroll compressor, comprising:

a casing;

a high/low pressure separation plate that is fixed to an inside of the casing and partitions a low-pressure portion defining a suction space and a high-pressure portion defining a discharge space;

a main frame fixed to the inside of the casing and disposed in the low-pressure portion;

an orbiting scroll supported on the main frame in an axial direction of the scroll compressor to perform an orbiting motion;

a non-orbiting scroll that is movable relative to one side surface of the main frame in the axial direction with the orbiting scroll interposed therebetween and forms a compression chamber together with the orbiting scroll;

a back pressure chamber assembly disposed between the high/low pressure separation plate and the non-orbiting scroll and having a back pressure chamber formed in an annular shape; and at least one back pressure hole formed through the non-orbiting scroll and a fixed back pressure plate of the back pressure chamber assembly such that the compression chamber and the back pressure chamber communicate with each other, wherein the at least one back pressure hole comprises a scroll-side back pressure hole that is formed in the non-orbiting scroll and communicates with the compression chamber, and a plate-side back pressure hole that is formed in the fixed back pressure plate of the back pressure chamber assembly and communicates with the scroll-side back pressure hole and the back pressure chamber, wherein a back pressure valve is disposed inside of the scroll-side back pressure hole to perform a sliding motion, and wherein the back pressure valve moves along a longitudinal direction of the at least one back pressure hole by a pressure difference between the compression chamber and the back pressure chamber, to vary a flow path area of the at least one back pressure hole.

15. The scroll compressor of claim 14, wherein the back pressure valve comprises:

a valve body that extends in the axial direction and having a hollow shape; and a plurality of holes formed through an inside of the valve body in the axial direction.

16. The scroll compressor of claim 15, wherein the valve body comprises:

a main body disposed on a side of the back pressure chamber;

an extension body that extends from the main body in the axial direction and disposed on a side of the compression chamber; and a pressing surface formed in a boundary region between the main body and the extension body.

17. The scroll compressor of claim 15, wherein the plurality of holes of the back pressure valve comprises:

a first hole formed in a compression chamber-side end portion of the valve body; and a second hole that communicates with the first hole and extends from the first hole to a back pressure chamber-side end portion of the valve body, wherein an inner diameter of the second hole is larger than an inner diameter of the first hole.

18. The scroll compressor of claim 17, wherein the back pressure valve comprises:

a side hole that communicates with the second hole and formed between the compression chamber-side end portion and the back pressure chamber-side end portion, and wherein an inner diameter of the side hole is larger than the inner diameter of the first hole.

19. The scroll compressor of claim 18, wherein the valve body has a first refrigerant flow path that penetrates therethrough in the axial direction, and a second refrigerant flow path that penetrates through an outer surface and an inside thereof, and wherein the first hole, the second hole, and the side hole are formed in the valve body to communicate with one another to define the first refrigerant flow path and the second refrigerant flow path.

20. The scroll compressor of claim 19, wherein the first refrigerant flow path is defined by the first hole and the second hole communicating with each other, and wherein the second refrigerant flow path is defined by an inner circumferential surface of the at least one back pressure hole, an outer surface of the compression chamber-side end portion, the side hole, and the second hole of the valve body which communicate with one another.

21. The scroll compressor of claim 19, wherein the first refrigerant flow path and the second refrigerant flow path are open when a pressure in the compression chamber is higher than a pressure in the back pressure chamber, and wherein the first refrigerant flow path is open and the second refrigerant flow path is closed when the pressure in the compression chamber is lower than the pressure in the back pressure chamber.

22. The scroll compressor of claim 17, wherein the valve body comprises:

a main body disposed on a side of the back pressure chamber;

an extension body that extends from the main body in the axial direction and disposed on a side of the compression chamber; and an inclined portion on the compression chamber-side end portion of the extension body, and wherein the inclined portion is formed such that an outer diameter of the inclined portion gradually decreases toward a circumference of the first hole.

23. The scroll compressor of claim 14, wherein a portion of the scroll-side back pressure hole is covered by one surface of the back pressure chamber assembly, and wherein the back pressure valve axially overlaps the one surface of the back pressure chamber assembly that covers the scroll-side back pressure hole.

24. The scroll compressor of claim 17, wherein the scroll-side back pressure hole comprises a first scroll-side back pressure hole that communicates with the plate-side back pressure hole, and a second scroll-side back pressure hole having a first end portion that communicates with the first scroll-side back pressure hole and a second end portion that communicates with the compression chamber, wherein an inner diameter of the first scroll-side back pressure hole is larger than an inner diameter of the second scroll-side back pressure hole, wherein the back pressure valve is inserted into the first scroll-side back pressure hole, and wherein the inner diameter of the first hole is smaller than the inner diameter of the second scroll-side back pressure hole.

25. The scroll compressor of claim 24, wherein a stepped portion is formed between the first scroll-side back pressure hole and the second scroll-side back pressure hole to restrict movement of the back pressure valve, and wherein the stepped portion is inclined in a direction toward the second scroll-side back pressure hole.

26. The scroll compressor of claim 24, wherein the valve body comprises:

a main body disposed on a side of the back pressure chamber;

an extension body that extends from the main body in the axial direction and disposed on a side the compression chamber; and a pressing surface formed in a boundary region between the main body and the extension body, and wherein an inner diameter of the extension body is larger than the inner diameter of the second scroll-side back pressure hole.

27. The scroll compressor of claim 14, wherein a length of the at least one back pressure hole from a first end at the compression chamber to a second end at the back pressure chamber is coaxially aligned with a central axis.

28. A scroll compressor, comprising:

a casing;

a high/low pressure separation plate that is fixed to an inside of the casing and partitions a low-pressure portion defining a suction space and a high-pressure portion defining a discharge space;

a main frame fixed to the inside of the casing and disposed in the low-pressure portion;

an orbiting scroll supported on the main frame in an axial direction of the scroll compressor to perform an orbiting motion;

a non-orbiting scroll that is movable relative to one side surface of the main frame in the axial direction with the orbiting scroll interposed therebetween and forms a compression chamber together with the orbiting scroll;

a back pressure chamber assembly disposed between the high/low pressure separation plate and the non-orbiting scroll and having a back pressure chamber formed in an annular shape; and at least one back pressure hole formed through the non-orbiting scroll and a fixed back pressure plate of the back pressure chamber assembly such that the compression chamber and the back pressure chamber communicate with each other, wherein a back pressure valve is disposed inside of the at least one back pressure hole and moves along a longitudinal direction of the at least one back pressure hole by a pressure difference between the compression chamber and the back pressure chamber, to vary a flow path area of the at least one back pressure hole, wherein the back pressure valve comprises:

a valve body that extends in the axial direction and having a hollow shape; and a plurality of holes formed through an inside of the valve body in the axial direction, wherein the plurality of holes of the back pressure valve comprises:

a first hole formed in a compression chamber-side end portion of the valve body; and a second hole that communicates with the first hole and extends from the first hole to a back pressure chamber-side end portion of the valve body, wherein an inner diameter of the second hole is larger than an inner diameter of the first hole, wherein the back pressure valve comprises:

a side hole that communicates with the second hole and formed between the compression chamber-side end portion and the back pressure chamber-side end portion, wherein an inner diameter of the side hole is larger than the inner diameter of the first hole, wherein the valve body is inserted into the at least one back pressure hole to perform a sliding motion, and has a first refrigerant flow path that penetrates therethrough in the axial direction, and a second refrigerant flow path that penetrates through an outer surface and an inside thereof, wherein the first hole, the second hole, and the side hole are formed in the valve body to communicate with one another to define the first refrigerant flow path and the second refrigerant flow path, wherein the first refrigerant flow path and the second refrigerant flow path are open when a pressure in the compression chamber is higher than a pressure in the back pressure chamber, wherein the first refrigerant flow path is open and the second refrigerant flow path is closed when the pressure in the compression chamber is lower than the pressure in the back pressure chamber, wherein the at least one back pressure hole comprise a scroll-side back pressure hole that is formed in the non-orbiting scroll and communicates with the compression chamber, and a plate-side back pressure hole that is formed in the fixed back pressure plate of the back pressure chamber assembly and communicates with the scroll-side back pressure hole and the back pressure chamber, and wherein the back pressure valve is disposed inside of the plate-side back pressure hole to perform a sliding motion.

29. The scroll compressor of claim 28, wherein the plate-side back pressure hole comprises a first plate-side back pressure hole that communicates with the back pressure chamber, and a second plate-side back pressure hole having a first end portion that communicates with the first plate-side back pressure hole and a second end portion that communicates with the scroll-side back pressure hole, wherein an inner diameter of the first plate-side back pressure hole is larger than an inner diameter of the second plate-side back pressure hole, wherein the back pressure valve is inserted into the first plate-side back pressure hole, and wherein the inner diameter of the first hole is smaller than the inner diameter of the second plate-side back pressure hole.

30. The scroll compressor of claim 29, wherein a plate-side stepped portion is formed between the first plate-side back pressure hole and the second plate-side back pressure hole to restrict movement of the back pressure valve, and wherein the plate-side stepped portion is inclined in a direction toward the second plate-side back pressure hole.

31. The scroll compressor of claim 29, wherein the valve body comprises:

a main body disposed on a side of the back pressure chamber;

an extension body that extends from the main body in the axial direction and disposed on a side of the compression chamber; and a pressing surface formed in a boundary region between the main body and the extension body, and wherein an inner diameter of the extension body is larger than the inner diameter of the second plate-side back pressure hole.

32. The scroll compressor of claim 29, wherein a plate-side valve restricting portion that restricts movement of the back pressure valve is provided at one end portion facing the back pressure chamber, of end portions of the first plate-side back pressure hole.

* * * * *